US012232670B2

(12) United States Patent
Huang et al.

(10) Patent No.: US 12,232,670 B2
(45) Date of Patent: Feb. 25, 2025

(54) CONTROLLING METHOD AND APPARATUS OF CLEANING ROBOT, CLEANING METHOD AND APPARATUS, SYSTEM, AND STORAGE MEDIUM

(71) Applicants: YUNJING INTELLIGENCE (SHENZHEN) CO., LTD., Shenzhen (CN); YUNJING INTELLIGENCE INNOVATION (SHENZHEN) CO., LTD., Shenzhen (CN)

(72) Inventors: Yifeng Huang, Shenzhen (CN); Tao Lu, Shenzhen (CN); Yuqian Wang, Shenzhen (CN); Chen Liang, Shenzhen (CN); Wentao Zhang, Shenzhen (CN)

(73) Assignees: YUNJING INTELLIGENCE (SHENZHEN) CO., LTD., Shenzhen (CN); YUNJING INTELLIGENCE INNOVATION (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 18/513,637

(22) Filed: Nov. 20, 2023

(65) Prior Publication Data

US 2024/0081599 A1 Mar. 14, 2024

Related U.S. Application Data

(63) Continuation of application No. PCT/CN2022/108344, filed on Jul. 27, 2022.

(51) Int. Cl.
*A47L 11/40* (2006.01)
*A47L 11/28* (2006.01)

(52) U.S. Cl.
CPC ..... *A47L 11/4011* (2013.01); *A47L 11/28* (2013.01); *A47L 11/4091* (2013.01); *A47L 2201/028* (2013.01); *A47L 2201/06* (2013.01)

(58) Field of Classification Search
None
See application file for complete search history.

(56) References Cited

U.S. PATENT DOCUMENTS

2017/0303761 A1* 10/2017 Chang ..... A47L 11/4002
2018/0074508 A1* 3/2018 Kleiner ..... G05D 1/0274
(Continued)

FOREIGN PATENT DOCUMENTS

CN 1100212 A 3/1995
CN 102727135 A 10/2012
(Continued)

OTHER PUBLICATIONS

First Office Action issued in related Chinese Application No. 202210894025.5, mailed Jan. 29, 2023, 11 pages.
(Continued)

*Primary Examiner* — Natasha N Campbell
*Assistant Examiner* — Pradhuman Parihar
(74) *Attorney, Agent, or Firm* — BAYES PLLC

(57) ABSTRACT

A controlling method and apparatus of a cleaning robot, a cleaning method and apparatus, a system, and a storage medium are provided. The method includes: controlling the cleaning robot to mop a preset cleaning region through a mopping member; obtaining a first dirtiness degree corresponding to the preset cleaning region; determining that the preset cleaning region includes a target region according to the first dirtiness degree, the target region being a region that needs to be repeatedly mopped; and controlling the cleaning robot to mop at least part of the target region through the mopping member after mopping of the preset cleaning region has been completed and after maintenance of the mopping member. Whether the at least part of the preset
(Continued)

cleaning region needs to be mopped repeatedly is determined according to the dirtiness degree of the preset cleaning region, and if yes, the at least part of the preset cleaning region is mopped repeatedly after the mopping member is maintained, thereby improving the cleaning effect of the preset cleaning region.

20 Claims, 14 Drawing Sheets

(56) References Cited

U.S. PATENT DOCUMENTS

| | | | | |
|---|---|---|---|---|
| 2020/0069140 | A1* | 3/2020 | Orzechowski | G05D 1/0016 |
| 2021/0330166 | A1* | 10/2021 | Wu | A47L 11/4091 |
| 2022/0071467 | A1 | 3/2022 | Zhang et al. | |
| 2022/0304538 | A1* | 9/2022 | Cai | B08B 3/08 |

FOREIGN PATENT DOCUMENTS

| | | | |
|---|---|---|---|
| CN | 105380575 | A | 3/2016 |
| CN | 107661070 | A | 2/2018 |
| CN | 109330522 | A | 2/2019 |
| CN | 109953700 | A | 7/2019 |
| CN | 110236455 | A | 9/2019 |
| CN | 110236456 | A | 9/2019 |
| CN | 111358342 | A | 7/2020 |
| CN | 111789538 | A | 10/2020 |
| CN | 112401763 | A | 2/2021 |
| CN | 112826383 | A | 5/2021 |
| CN | 112986079 | A | 6/2021 |
| CN | 113040668 | A | 6/2021 |
| CN | 113273933 | A | 8/2021 |
| CN | 113455967 | A | 10/2021 |
| CN | 113854903 | A | 12/2021 |
| CN | 215457703 | U | 1/2022 |
| CN | 114052601 | A | 2/2022 |
| CN | 215838862 | U | 2/2022 |
| CN | 114431802 | A | 5/2022 |
| CN | 114468866 | A | 5/2022 |
| CN | 114568998 | A | 6/2022 |
| CN | 114711676 | A | 7/2022 |
| JP | 2014128782 | A | 7/2014 |
| KR | 20100104427 | A | 9/2010 |

OTHER PUBLICATIONS

First Office Action issued in related Chinese Application No. 202210894039.7, mailed Feb. 1, 2023, 9 pages.

International Search Report issued in corresponding International Application No. PCT/CN/2022/108344, mailed Jul. 27, 2022, 4 pages.

* cited by examiner

| Mopping member dirtiness degree | Less than the second dirt amount threshold | Greater than or equal to the second dirt amount threshold and less than the first dirt amount threshold | Greater than or equal to the first dirt amount threshold |
|---|---|---|---|
| Corresponding behavior | No repeated mopping | Repeated mopping is required<br>Repeated mopping after mopping of all the preset cleaning regions has been completed | Repeated mopping is required<br>Repeated mopping immediately |
| Corresponding cleaning threshold | Thorough cleaning, end cleaning the mopping member when reaching the $0^{th}$ threshold | No need to thoroughly clean, end cleaning the mopping member when reaching the $1^{st}$ threshold | No need to thoroughly clean, end cleaning the mopping member when reaching the $2^{nd}$ threshold |

FIG. 9

CONTROLLING METHOD AND APPARATUS OF CLEANING ROBOT, CLEANING METHOD AND APPARATUS, SYSTEM, AND STORAGE MEDIUM

CROSS-REFERENCE TO RELATED APPLICATION

The present application is a continuation of International Application No. PCT/CN2022/108344, filed on Jul. 27, 2022, which is hereby incorporated by references in its entirety.

TECHNICAL FIELD

The present disclosure relates to the field of cleaning technologies, in particular to a controlling method and apparatus of a cleaning robot, a cleaning method and apparatus, a system, and a storage medium.

TECHNICAL BACKGROUND

Cleaning robots can be used for automatic cleaning of the ground in scenarios such as household indoor cleaning, large place cleaning, and the like. The cleaning robot mops the ground through a mopping member, which usually becomes dirty after mopping the ground for a period of time, and the cleaning robot needs to return to a base station to clean the mopping member. In the related art, the cleaning robot commonly continues to mop the un-mopped ground directly after the mopping member is cleaned, without monitoring whether the mopped ground is clean or not, which makes some regions of the ground be not fully cleaned and still dirty.

SUMMARY

The present disclosure provides a controlling method and apparatus of a cleaning robot, a cleaning method and apparatus, a system, and a storage medium, aiming to solve the technical problems in the related art that some regions of the ground are not fully cleaned and still dirty during the cleaning robot cleaning the ground.

According to a first aspect, an embodiment of the present disclosure provides a controlling method for a cleaning robot, including:

controlling the cleaning robot to mop a preset cleaning region through a mopping member;

obtaining a first dirtiness degree corresponding to the preset cleaning region;

determining that the preset cleaning region includes a target region according to the first dirtiness degree, the target region being a region that needs to be repeatedly mopped; and controlling the cleaning robot to mop at least part of the target region through the mopping member after mopping of the preset cleaning region has been completed and after maintenance of the mopping member.

According to a second aspect, an embodiment of the present disclosure provides a cleaning method for a mopping member which is applied to a cleaning system, and the method includes:

performing a mopping member cleaning task;

obtaining a mopping member dirtiness degree of the mopping member; and determining a cleaning threshold according to a value range where the mopping member dirtiness degree is located, and ending the mopping member cleaning task according to the cleaning threshold.

According to a third aspect, an embodiment of the present disclosure provides a cleaning method for a mopping member which is applied to a cleaning system, and the method includes:

performing a mopping member cleaning task;

obtaining a task progress of a preset cleaning task, the preset cleaning task comprising mopping a preset cleaning region of a cleaning task map through the mopping member;

determining a cleaning threshold of the mopping member cleaning task according to the task progress of the preset cleaning task; and ending the mopping member cleaning task according to the cleaning threshold.

According to a fourth aspect, an embodiment of the present disclosure provides a control apparatus which includes a memory and a processor;

the memory is configured to store a computer program; and the processor is configured to execute the computer program, and, when executing the computer program, implement the operations in the foregoing controlling method for the cleaning robot and the operations in the foregoing cleaning method for the mopping member.

According to a fifth aspect, an embodiment of the present disclosure provides a base station. The base station is at least configured to clean the mopping member of the cleaning robot, and the base station includes the foregoing control apparatus.

According to a sixth aspect, an embodiment of the present disclosure provides a cleaning robot. The cleaning robot is configured to clean a floor, and the cleaning robot includes:

the foregoing control apparatus.

According to a seventh aspect, an embodiment of the present disclosure provides a cleaning system, including:

a cleaning robot, the cleaning robot including a walking unit and a mopping member, the walking unit being configured to drive the cleaning robot to move, so as to allow the mopping member to mop a floor;

a base station, the base station being at least configured to clean or replace the mopping member of the cleaning robot; and the foregoing control apparatus.

According to an eighth aspect, an embodiment of the present disclosure provides a cleaning system, including:

a cleaning robot, the cleaning robot including a walking unit and a mopping member, the walking unit being configured to drive the cleaning robot to move, so as to allow the mopping member to mop a floor;

a base station, the base station including a dirt detection apparatus which is configured to detect a mopping member dirtiness degree of the cleaning robot; and the foregoing control apparatus.

According to a ninth aspect, an embodiment of the present disclosure provides a cleaning system including:

a first cleaning robot, the first cleaning robot including a walking unit and a mopping member, the walking unit being configured to drive the first cleaning robot to move, so as to allow the mopping member to mop a floor;

a base station, the base station being at least configured to clean the mopping member of the first cleaning robot; and the foregoing control apparatus; and the cleaning system further includes:

a handheld cleaning device or a second cleaning robot;

the control apparatus or the first cleaning robot is capable of sending information of a target region to the handheld cleaning device or the second cleaning robot, the target region being a region that needs to be repeatedly mopped.

According to a tenth aspect, an embodiment of the present disclosure provides a computer-readable storage medium storing a computer program. the computer program, when being executed by a processor, causes the processor to implement the operations in the foregoing controlling method for the cleaning robot and the operations in the foregoing cleaning method for the mopping member.

The embodiments of the present disclosure provide a controlling method and apparatus of a cleaning robot, a cleaning method and apparatus, a system, and a storage medium. The method includes: controlling the cleaning robot to mop a preset cleaning region with a mopping member; obtaining a first dirtiness degree corresponding to the preset cleaning region; determining that the preset cleaning region includes a target region according to the first dirtiness degree, the target region being a region that needs to be repeatedly mopped; and controlling the cleaning robot to mop at least part of the target region with the mopping member, after mopping of the preset cleaning region has been completed and maintenance of the mopping member. Whether the at least part of the preset cleaning region needs to be mopped repeatedly will be determined based on the dirtiness degree of the preset cleaning region, and if yes, the at least part of the preset cleaning region will be mopped repeatedly after the mopping member is maintained, thereby improving the cleaning effect of the preset cleaning region.

It should be understood that the foregoing general description and the following detailed description are merely exemplary and explanatory, and do not limit the disclosed content of the embodiments of the present disclosure.

BRIEF DESCRIPTION OF DRAWINGS

In order to illustrate the technical solutions of the embodiments of the present disclosure more clearly, the accompanying drawings are briefly described below. The drawings described below are some of the embodiments, and it would be obvious for those skilled in the art to obtain other drawings based on these drawings without any creative efforts.

FIG. 9 is a schematic diagram showing a corresponding relationship between a value range and a cleaning threshold according to an embodiment of the present disclosure.

DETAILED DESCRIPTION

Figure 1:
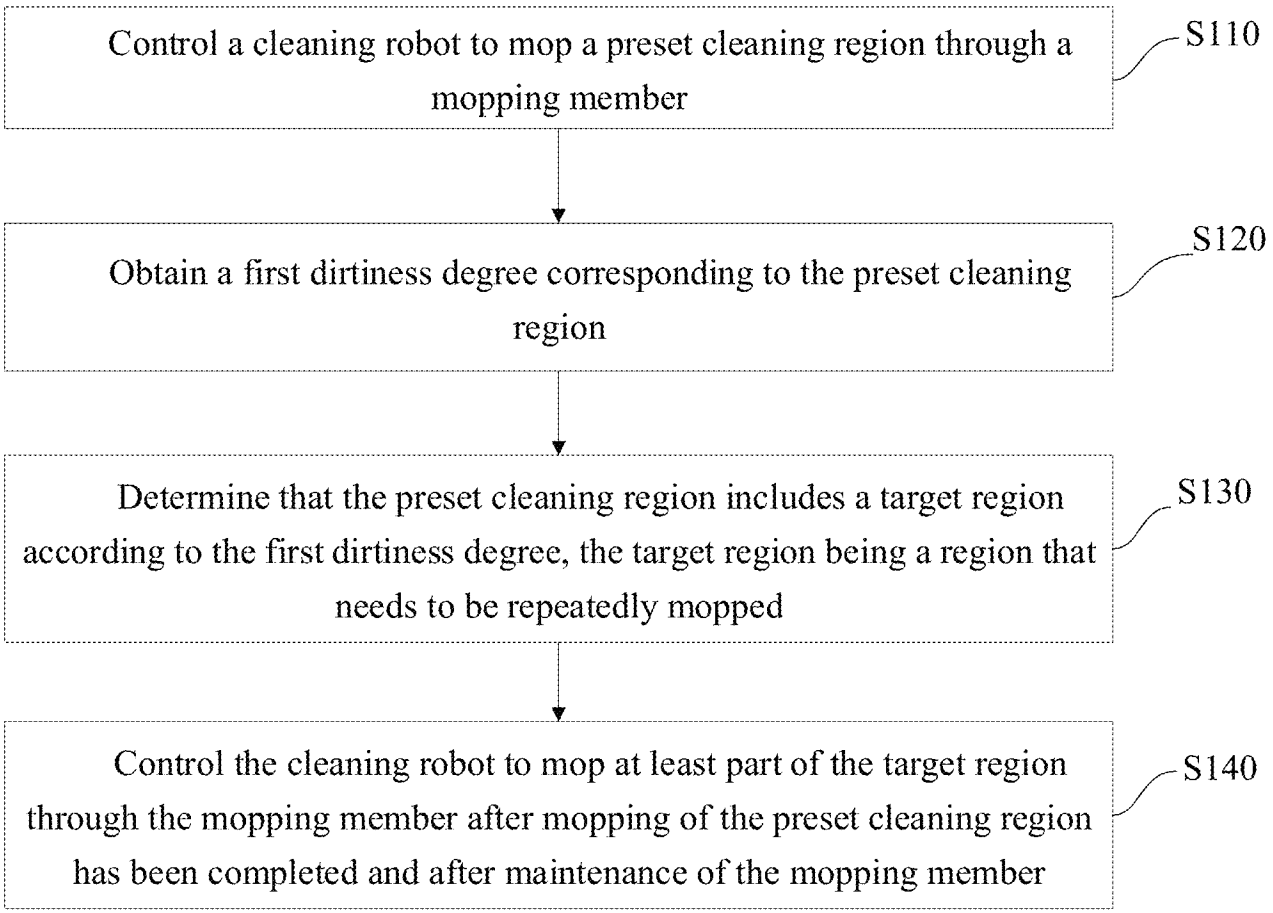
FIG. 1 is a schematic flowchart of a controlling method for a cleaning robot according to an embodiment of the present disclosure.

The technical solutions in the embodiments of the present disclosure are clearly and completely described with reference to the accompanying drawings in the embodiments of the present disclosure. The embodiments described herein are some rather than all of the embodiments of the present disclosure. Based on the embodiments in the present disclosure, all other embodiments obtained by those skilled in the art without any creative efforts shall fall within the protection scope of the present disclosure.

The flowcharts shown in the drawings are merely illustrative and do not necessarily include all of the contents and operations/steps, nor do they have to be executed in the order described herewith. For example, some operations/steps may be decomposed, combined, or partially combined, so the actual execution order may be changed in the sense of an actual situation.

Some embodiments of the present disclosure are described in detail with reference to the accompanying drawings. In the case of no conflict, the following embodiments and features in the embodiments can be combined with each other.

Referring to FIG. 1, which is a schematic flowchart of a controlling method for a cleaning robot according to an embodiment of the present disclosure. The controlling method may be applied to a cleaning system, and is configured to control a cleaning robot in the cleaning system to execute a cleaning task, so as to clean a to-be-cleaned region corresponding to a cleaning task map.

The to-be-cleaned region may be any region to be cleaned, such as a house, a room in the house, a partial region of the room, a large place, or a partial region of the large place. From another perspective, the to-be-cleaned region may refer to a relatively large region to be cleaned for the first time, such as, an entire room; or may refer to a partial region of the relatively large region that needs to be patching cleaned after the relatively large region has been cleaned for the first time, such as, a near-wall region in the room, or an obstacle region in the room.

Figure 2:
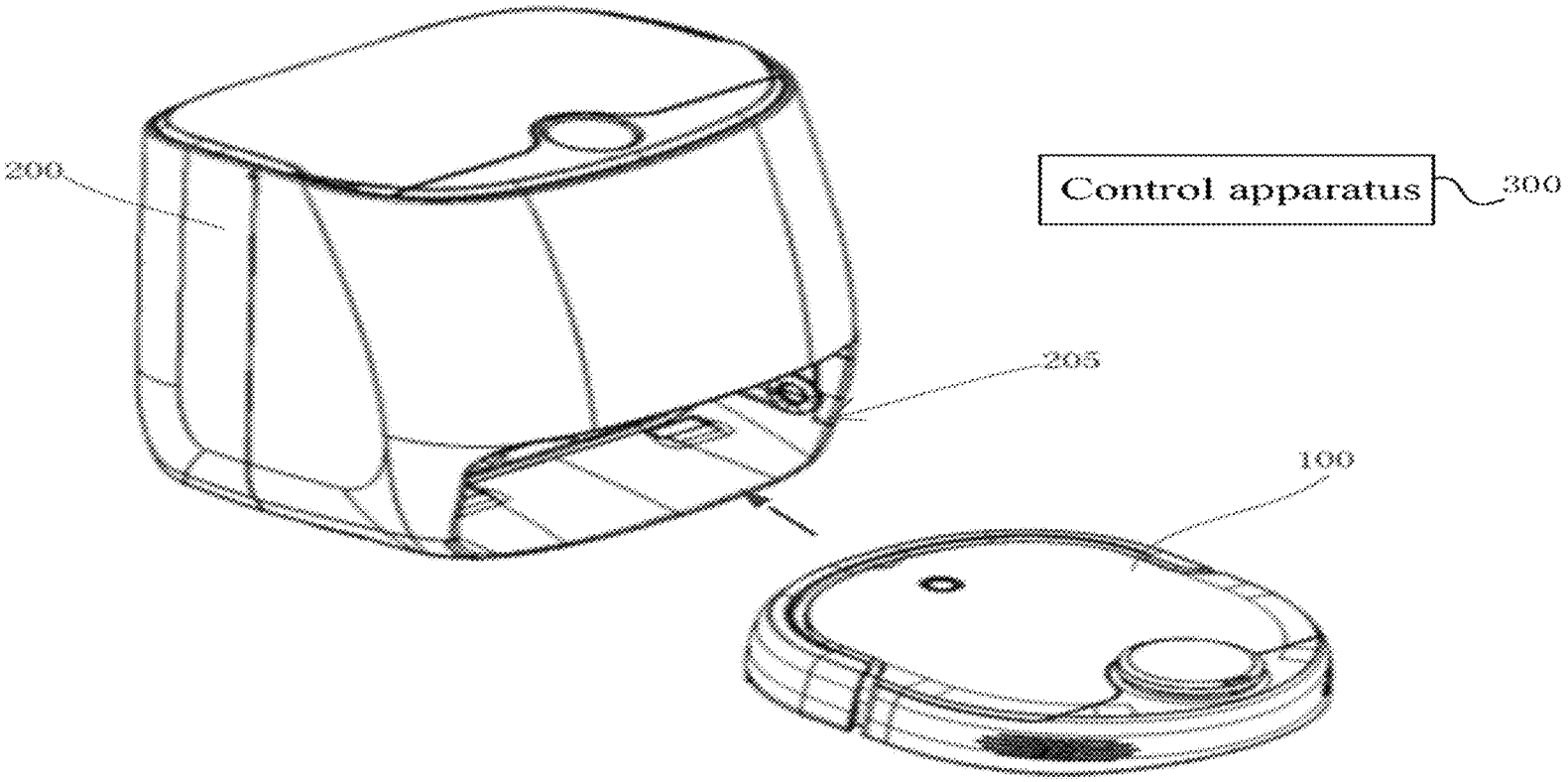
FIG. 2 is a schematic diagram of a cleaning system according to an embodiment of the present disclosure.

As shown in FIG. 2, the cleaning system includes one or more cleaning robots 100, and one or more base stations 200. The base station 200 is configured to cooperate with the cleaning robot 100. For example, the base station 200 may charge the cleaning robot 100, and provide a docking position for the cleaning robot 100. The base station 200 may also perform maintenance on a mopping member 110 of the cleaning robot 100. For example, the base station 200 may clean or replace the mopping member 110. The mopping member 110 is configured to mop the floor.

The cleaning system may further include a control apparatus 300. The control apparatus 300 may be configured to implement the steps in the controlling method for the cleaning robot according to the embodiments of the present disclosure and/or the steps in the foregoing cleaning method for the mopping member. In some embodiments, a robot controller 104 of the cleaning robot 100 and/or a base station controller 206 of the base station 200 may be separately served as the control apparatus 300 or cooperatively served as the control apparatus 300, to implement the steps in the method according to the embodiments of the present disclosure. In some other embodiments, the cleaning system includes a separate control apparatus 300 which is configured to implement the steps in the method according to the embodiments of the present disclosure. The control apparatus 300 may be disposed on the cleaning robot 100, or on the base station 200. The present disclosure is certainly not limited thereto, for example, the control apparatus 300 may be an apparatus other than the cleaning robot 100 and the base station 200, such as a home intelligent terminal, a general control apparatus, and the like.

The cleaning robot 100 may be configured to automatically mop the floor in the application scenarios such as household indoor cleaning, large space cleaning, and the like.

Figure 3:
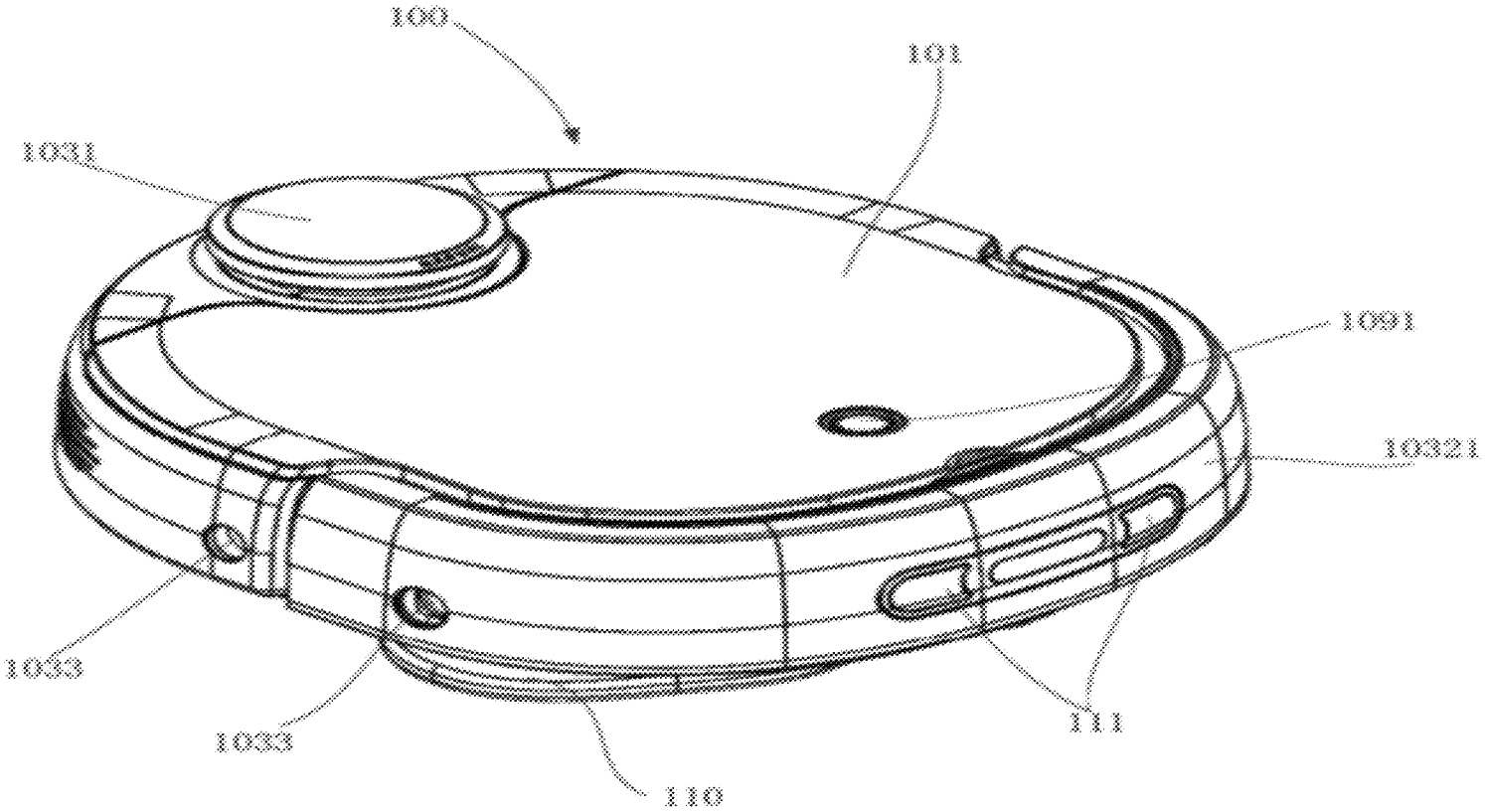
FIG. 3 is a schematic structural diagram of a cleaning robot according to an embodiment of the present disclosure.
Figure 4:
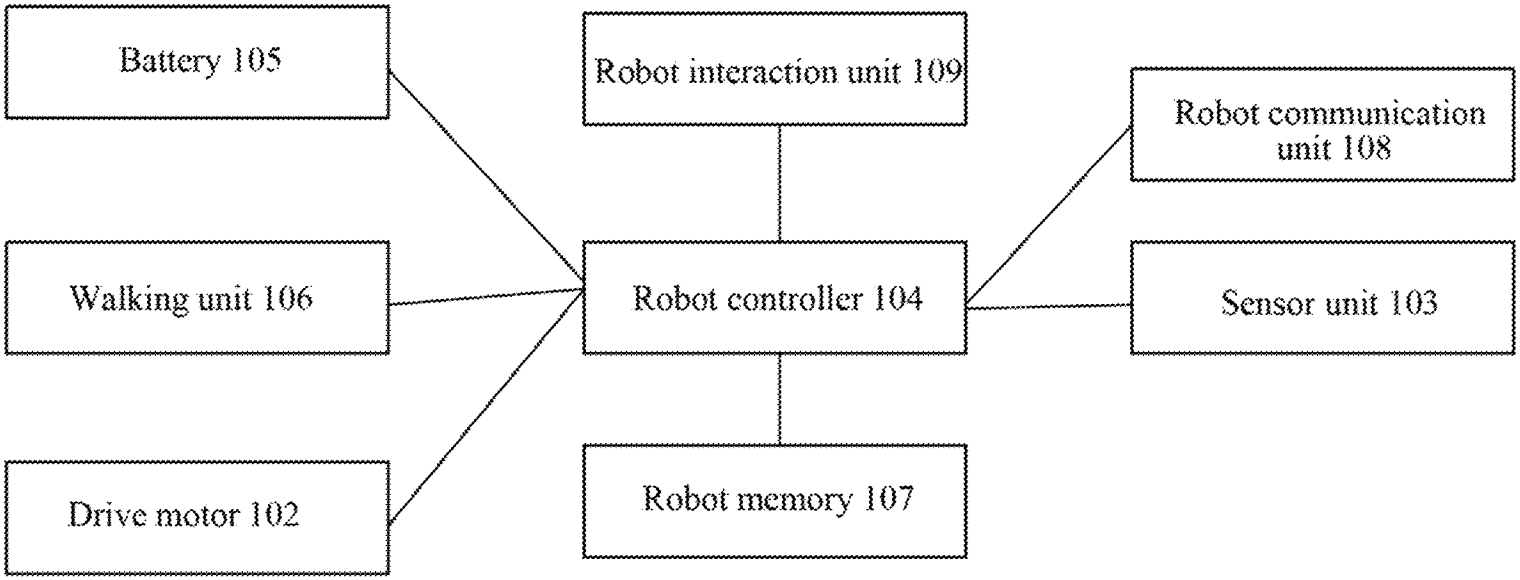
FIG. 4 is a schematic block diagram of a cleaning robot according to an embodiment of the present disclosure.

FIG. 3 is a schematic structural view of the cleaning robot 100 according to an embodiment, and FIG. 4 is a schematic block diagram of the cleaning robot 100 according to an embodiment. The cleaning robot 100 includes a robot body 101, a drive motor 102, a sensor unit 103, a robot controller 104, a battery 105, a walking unit 106, a robot memory 107, a robot communication unit 108, a robot interaction unit 109, a mopping member 110, and a charging member 111.

The robot body 101 may have a circular structure, a square structure, or the like. In an exemplary embodiment of the present disclosure, the robot body 101 having a D-shaped structure is selected as an example to be described. As shown in FIG. 1, the front part of the robot body 101 has a rounded rectangular structure, and the rear part has a semicircular structure. In an exemplary embodiment of the present application, the robot body 101 is a left-right symmetrical structure.

The mopping member 110 is configured to mop the floor. There may be one or more mopping members 110. The mopping member 110 is, for example, a mop. The mopping member 110 is arranged at the bottom of the robot body 101, specifically at the front of the bottom of the robot body 101. The drive motor 102 is disposed inside the robot body 101. Two rotating shafts extend out from the bottom of the robot body 101, and the mopping member 110 is sleeved on the rotating shafts. The drive motor 102 drives the rotating shafts to rotate, so that the rotating shafts drive the mopping member 110 to rotate.

The walking unit 106 is a component related to the movement of the cleaning robot 100, and is configured to drive the cleaning robot 100 to move, so as to allow the mopping member 110 to mop the floor.

The robot controller 104 is disposed inside the robot body 101, and is configured to control the cleaning robot 100 to perform specific operations. The robot controller 104 may be, for example, a central processing unit (CPU), a microprocessor, or the like. As shown in FIG. 4, the robot controller 104 is electrically connected to the components such as the battery 105, the robot memory 107, the drive motor 102, the walking unit 106, the sensor unit 103, and the robot interaction unit 109, to control these components.

It should be understood that the cleaning robot 100 described herein is merely a specific example, which does not limit the cleaning robot 100 provided by the embodiments of the present disclosure. The cleaning robot 100 may also be implemented in other specific manners. For example, in some other embodiments, the cleaning robot may include more or fewer components than the cleaning robot 100 shown in FIG. 3 or FIG. 4.

Figure 5:
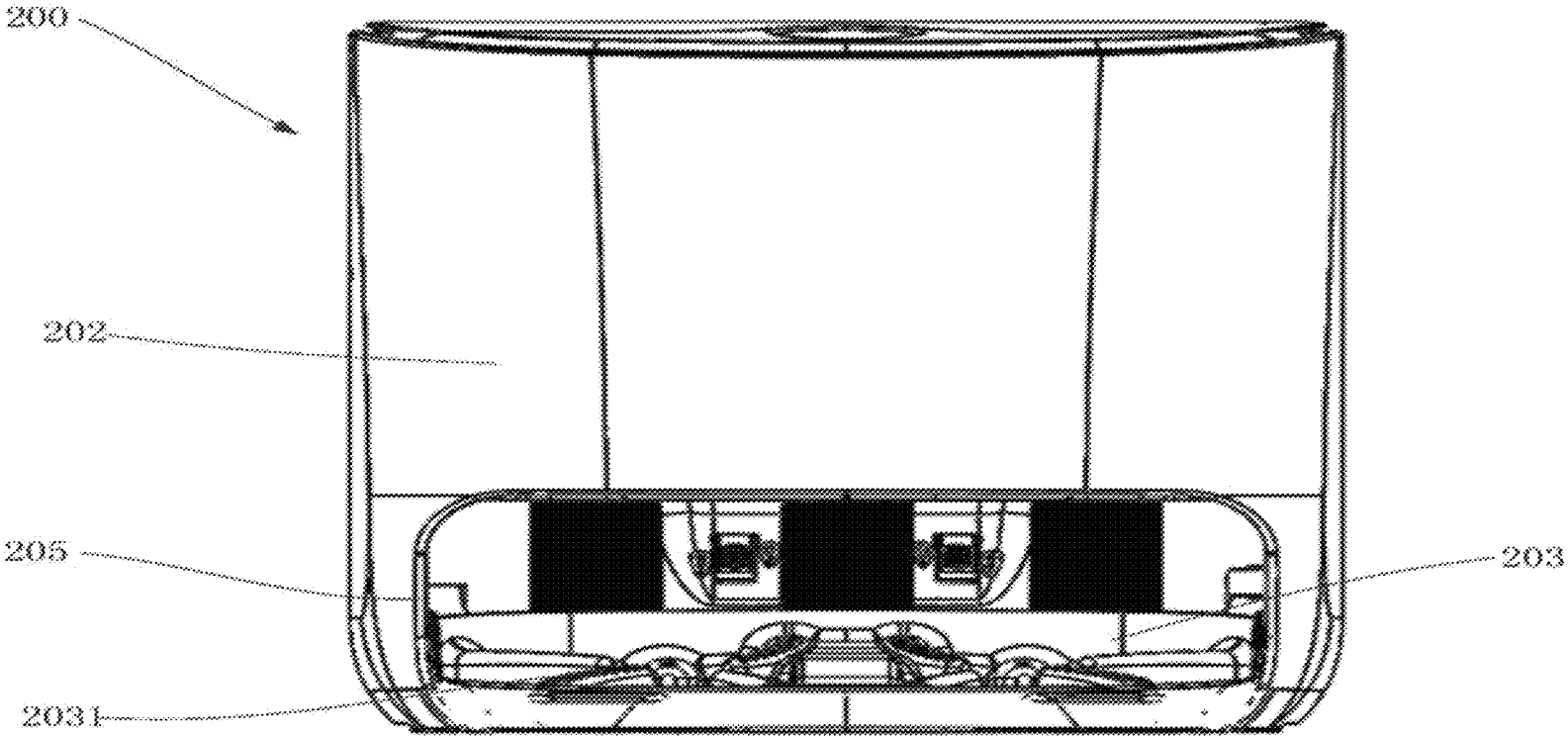
FIG. 5 is a schematic structural diagram of a base station according to an embodiment of the present disclosure.
Figure 6:
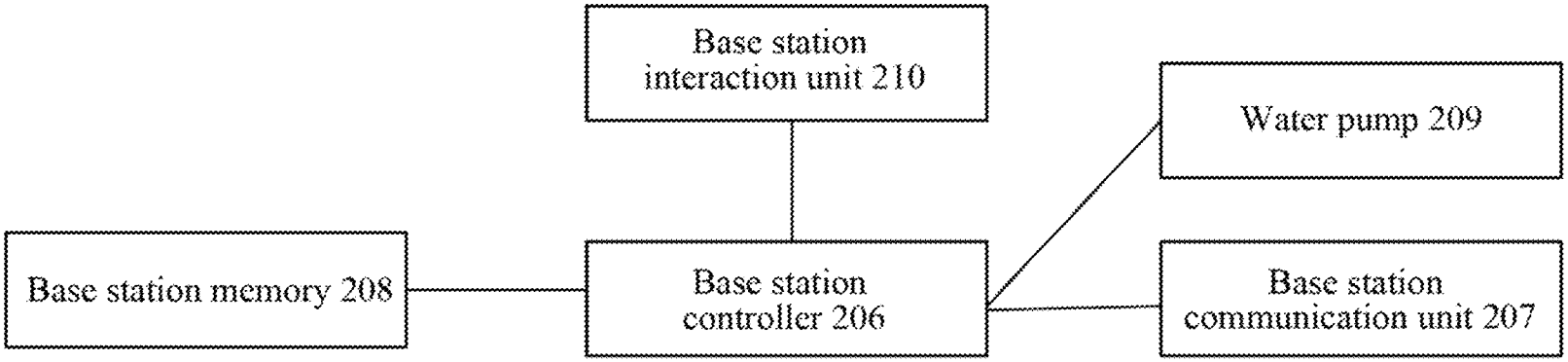
FIG. 6 is a schematic block diagram of a base station according to an embodiment of the present disclosure.

FIG. 5 is a schematic structural diagram of the base station 200 according to an embodiment, and FIG. 6 is a schematic block diagram of the base station 200 according to an embodiment. The base station 200 is configured to cooperate with the cleaning robot 100. For example, the base station 200 may charge the cleaning robot 100, and provide a docking position for the cleaning robot 100. The base station 200 may also clean the mopping member 110 of the cleaning robot 100. The mopping member 110 is configured to mop the floor.

As shown in FIG. 5 and FIG. 6, the base station 200 in the embodiments of the present disclosure includes a base station body 202, a cleaning sink 203, and a water tank (not shown). The cleaning sink 203 is arranged on the base station body 202, and is configured to clean the mopping member 110 of the cleaning robot. A cleaning rib 2031 provided on the cleaning sink 203 may scrape and clean the mopping member 110.

An entrance 205 is disposed on the base station body 202, and the entrance 205 leads to the cleaning sink 203. The cleaning robot 100 may enter the base station 200 through the entrance 205, so that the cleaning robot 100 can then dock at a preset docking position on the base station 200. The water tank is arranged inside the base station body 202, and includes a clean water tank and a sewage tank. The clean water tank is configured to store clean water. After the cleaning robot 100 is docked on the base station 200, the mopping member 110 of the cleaning robot 100 is received in the cleaning sink 203. The clean water tank supplies the cleaning sink 203 with cleaning water for cleaning the mopping member 110. The sewage generated after cleaning the mopping member is collected into the sewage tank. In some embodiments, a top cover (not shown in the figure) may be disposed on the base station body 202, and the top cover can be opened to take out the water tank from the base station body 202 by users. In some other embodiments, the water tank is connected to a water inlet pipe (for example, a tap water pipe) and a sewage pipe (for example, a drain pipe), and in this case, the water tank may be fixed in the base station body 202. In some other embodiments, the base station 200 may not be provided with one or both of the clean water tank and the sewage tank, for example, cleaning water is directly supplied to the cleaning sink 203 from the water inlet pipe, and sewage generated after cleaning the mopping member 110 is directly discharged through the sewage pipe.

In some embodiments, the base station 200 further includes a dirt detection apparatus, which is configured to detect a mopping member dirtiness degree of the mopping member 110. Illustratively, the dirt detection apparatus includes at least one of the following: a vision sensor, and a sewage detection sensor. For example, the vision sensor is capable of obtaining image or color information of the mopping member 110 to determine the mopping member dirtiness degree of the mopping member 110, for example, the darker the grayscale on the surface of the mopping member 110, the greater the mopping member dirtiness degree. For example, the sewage detection sensor may obtain a detection value of the sewage generated by cleaning the mopping member 110 to determine the mopping member dirtiness degree of the mopping member 110. In some embodiments, the sewage detection sensor includes at least one of the following: a visible light detection sensor, an infrared detection sensor, and a total dissolved solid detection sensor. For example, the infrared detection sensor acquires a turbidity of the sewage, the visible light detection sensor acquires a chroma of the sewage, and the total dissolved solid detection sensor acquires a water conductivity of the sewage. The mopping member dirtiness degree may be determined according to one or more of the turbidity, the chroma, and the water conductivity. For example, the greater the turbidity or the water conductivity of the sewage, the greater the mopping member dirtiness degree.

Referring to FIG. 6, the base station 200 may further include a base station controller 206, a base station communication unit 207, a base station memory 208, a water pump 209, and a base station interaction unit 210.

The base station controller 206 is disposed inside the base station body 202, and is configured to control the base station 200 to perform specific operations. The base station controller 206 may be, for example, a CPU, or a microprocessor, or the like. The base station controller 206 is electrically connected to the base station communication unit 207, the base station memory 208, the water pump 209, and the base station interaction unit 210.

The base station memory 208 is arranged on the base station body 202. The base station memory 208 stores computer-executable instructions. The computer-executable instructions, when executed by the base station controller 206, implement corresponding operations. The base station memory 208 is also configured to store parameters for the base station 200. The base station memory 208 includes, but is not limited to, a disk memory, a compact disc read-only memory (CD-ROM), an optical memory, and the like.

The water pump 209 is disposed inside the base station body 202. For example, there are two water pumps 209, one of which is configured to control the clean water tank to supply cleaning water to the cleaning sink 203, and the other is configured to collect the sewage into the sewage tank after cleaning the mopping member 110. The present disclosure is certainly not limited thereto. For example, cleaning water can be directly supplied to the cleaning sink 203 from a water inlet pipe, and the cleaning water is supplied to the cleaning sink 203 by controlling a solenoid valve on the water inlet pipe.

The base station communication unit 207 is arranged on the base station body 202, and is configured to communicate with an external device. The base station 200 may communicate with a terminal and/or the cleaning robot 100 through a WI-FI communication module.

The base station interaction unit 210 is configured to interact with users. For example, a cleaning mode may be obtained through the base station interaction unit 210; the base station interaction unit 210 may display information of a target region for users to choose to repeatedly mop the target region, such as controlling the cleaning robot to mop the target region based on the user's determined operation. The base station interaction unit 210 includes, for example, a display screen and a control button. The display screen and the control button are arranged on the base station body 202. The display screen is configured to display information for users, and the control button is configured to be pressed by users, so as to control the base station 200 to startup, shutdown, or the like.

Typically, the cleaning robot 100 can be configured to mop the floor. After a period of time mopping the floor, the cleaning robot 100 becomes dirty and drives to the base station 200. The cleaning robot 100 will dock at a preset docking position in the base station 200 after it enters the base station 200 through the entrance 205 of the base station 200, and at that time, the mopping member 110 of the cleaning robot 100 is received in the cleaning sink 203. By the water pump 209, the cleaning water in the clean water tank of the base station 200 is driven to flow to the cleaning sink 203 and is sprayed onto the mopping member 110 through a liquid inlet structure on the cleaning sink 203. Simultaneously, the mopping member 110 is scraped and cleaned by the protruding cleaning rib 2031 in the cleaning sink. The sewage generated during cleaning the mopping member 110 flows out of the cleaning sink 203 through a liquid discharge structure on the cleaning sink 203, and is then collected in the sewage tank by way of the water pump 209.

It should be understood that the foregoing cleaning system is merely a specific example, and is not to limit the cleaning robot and the base station in the embodiments of the present disclosure. The base station in the embodiments of the present disclosure can also be implemented in other ways. For example, the base station does not include the water tank, and the base station body is connected to a tap water pipe and a drain water pipe, so that the mopping member 110 of the cleaning robot 100 can be cleaned by the tap water from the tap water pipe, and sewage generated during cleaning the mopping member 110 flows out of the base station 200 from the cleaning sink 203 through the drain water pipe. Alternatively, in some other embodiments, the base station 200 may include more or fewer components than the base station as shown in FIG. 5 or FIG. 6.

The cleaning robot of the embodiments of the present disclosure may also be implemented in other specific ways. In some embodiments, the cleaning robot may include a cleaning mechanism configured to clean the mopping member. Typically, the cleaning robot includes a water tank and a dirt detection apparatus. The water tank supplies water to the cleaning mechanism to clean the mopping member, and the dirt detection apparatus is configured to detect mopping member dirtiness degree of the mopping member. For example, the controlling method for the cleaning robot according to the embodiments of the present disclosure may be configured to control the cleaning robot to mop a preset cleaning region. For example, dirtiness degree of the preset cleaning region is determined according to a mopping member dirtiness degree of the mopping member, and mopping of the preset cleaning region is based on the dirtiness degree of the preset cleaning region. The cleaning robot may control the cleaning mechanism to self-clean the mopping member while cleaning the floor. For example, the cleaning method for the mopping member according to the embodiments of the present disclosure may be configured to control the cleaning mechanism of the cleaning robot to self-clean the mopping member. For example, a cleaning threshold is determined according to a value range where the mopping member dirtiness degree of the mopping member falls within, and the mopping member cleaning task is ended according to the cleaning threshold. It should be understood that, the cleaning method for the mopping member according to the embodiments of the present disclosure may be applied to the base station or the cleaning robot. For example, the cleaning method for the mopping member is configured to control the cleaning mechanism (which, for example, includes a cleaning sink 203, a cleaning rib 2031) on the base station, or control the cleaning mechanism on the cleaning robot.

The inventors of the present disclosure also found that in related art, the cleaning robot directly mops the un-mopped floor after the mopping member is cleaned without monitoring whether the mopped floor is clean or not, which makes some regions of the floor be not fully cleaned and still dirty.

Based on this, the inventors of the present disclosure improve the controlling method for the cleaning robot, wherein whether at least part of the preset cleaning region needs to be mopped repeatedly is determined according to a dirtiness degree of the preset cleaning region, and if needed, make the mopping member repeatedly mop the at least part of the preset cleaning region after the mopping member is maintained, thereby improving the cleaning effect of the preset cleaning region.

As shown in FIG. 1, the controlling method for the cleaning robot according to an embodiment of the present disclosure includes step S110 to step S140.

Step S110, control a cleaning robot to mop a preset cleaning region through a mopping member.

In some embodiments, the preset cleaning region may be determined based on a room in a cleaning task map, and/or a workload threshold of the cleaning robot. Typically, the workload for each preset cleaning region is less than or equal to the workload threshold. Typically, one room may be one preset cleaning region, or one room includes a plurality of preset cleaning regions. The present disclosure is certainly not limited thereto. For example, the preset cleaning region may include one room and at least a partial region of another room. In addition, the preset cleaning region may be determined according to a division operation by a user on the cleaning task map, or may be determined by division based on predetermined rules for dividing the region.

In some embodiments, a cleaning task of the cleaning robot includes mopping a plurality of preset cleaning regions, such as, mopping a plurality of preset cleaning regions in the cleaning task map.

Typically, the workload of the cleaning robot includes at least one of the following: an dirt amount adhering to the mopping member during the process of the mopping member of the cleaning robot mopping the floor, an amount of power consumed during the process of the cleaning robot cleaning the floor, an amount of water consumed during the process of the cleaning robot cleaning the floor, an amount of dirt collected during the process of the cleaning robot cleaning the floor, an amount of sewage collected during the process of the cleaning robot cleaning the floor, an area of the floor cleaned by the cleaning robot, and a path length of the cleaning robot during cleaning the floor. In the embodiments of the present disclosure, the workload of the cleaning robot including the dirt amount collected during the process of the cleaning robot cleaning the floor, such as the dirt amount collected by the mopping member, is selected as an example to be described.

Figure 7:
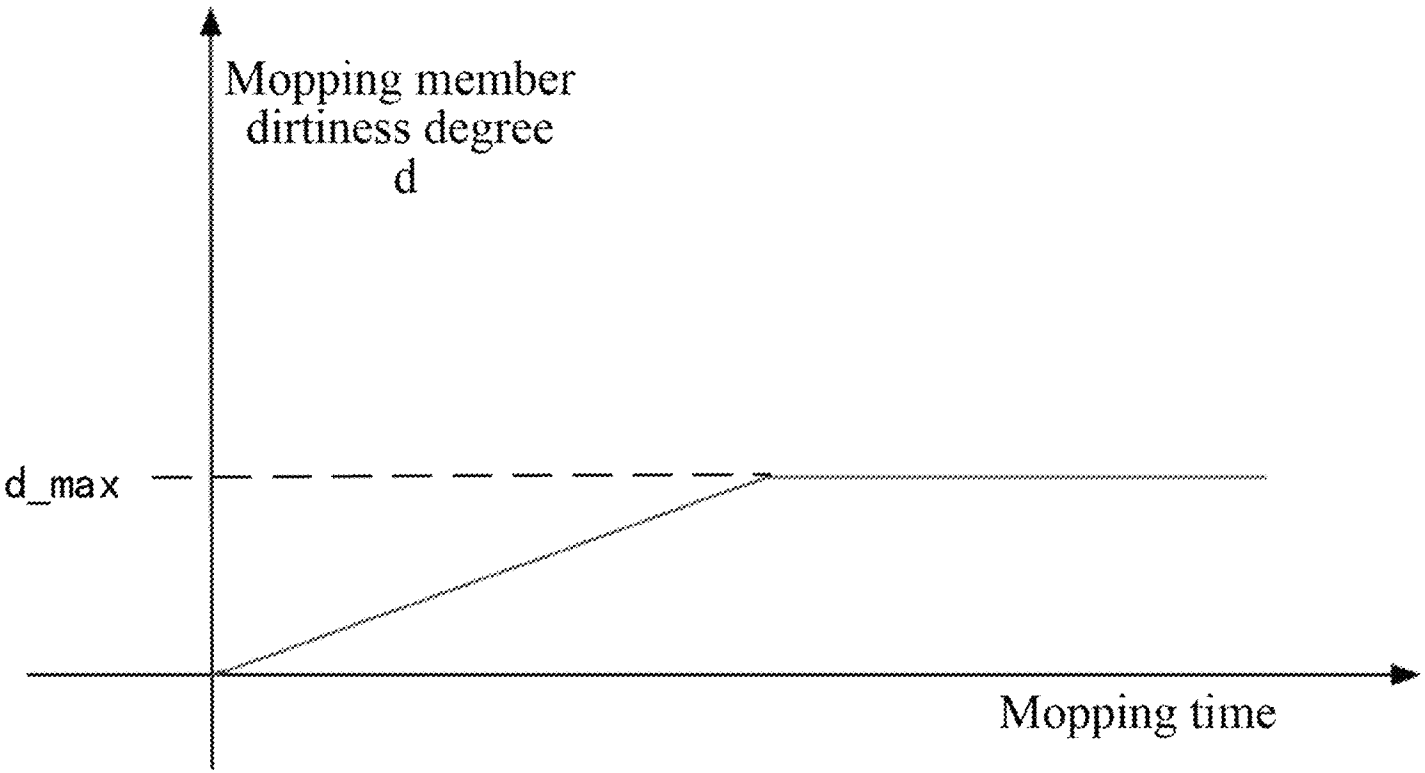
FIG. 7 is a schematic diagram showing a dirtiness degree change of a mopping member dirtiness degree according to an embodiment of the present disclosure.

In some embodiments, before finishing the workload corresponding to the workload threshold, the cleaning robot needs to interrupt the current cleaning task and moves to the base station for maintenance to ensure a better cleaning effect. Typically, the mopping member, such as a mop, has limited capability to collect dirt. Referring to FIG. 7, it shows a relationship between the dirt amount collected by the mopping member (namely mopping member dirtiness degree d) and mopping time, with the mopping member from a status of being freshly cleaned to a status of the mopping member dirtiness degree reaching a maximum value, and the cleaning robot moving forward at a constant speed and no repeating mopping a floor (having infinite area) of uniform distribution of dirt. When the mopping member dirtiness degree d reaches a maximum value d_max, the mopping member will not get dirtier in the subsequent mopping of floor and has a very poor cleaning effect, so that it can be determined that the mopping member dirtiness degree d has reached the workload threshold which needs to stop mopping. In addition, the cleaning robot may be controlled to move to the base station to receive maintenance, such as cleaning the mopping member or replacing the mopping member with another cleaned mopping member. Typically, the maximum dirt value d_max of the mopping member is an empirical value, which may be measured, for example, in the laboratory.

Step S120, obtain a first dirtiness degree corresponding to the preset cleaning region.

Illustratively, when the cleaning robot moves in the preset cleaning region, such as mopping the preset cleaning region, the first dirtiness degree corresponding to the preset cleaning region is obtained by a sensor mounted on the cleaning robot, such as a vision sensor, and/or an infrared sensor. It should be understood that the corresponding first dirtiness degree may be obtained before or during the process of mopping the preset cleaning region. The present disclosure is certainly not limited thereto. For example, the first dirtiness degree corresponding to the preset cleaning region may be obtained by a sensor that is not mounted on the cleaning robot, such as a vision sensor mounted on the roof.

In some embodiments, the obtaining the first dirtiness degree corresponding to the preset cleaning region includes: obtaining the mopping member dirtiness degree of the mopping member after the cleaning robot has completed mopping of the preset cleaning region through the mopping member; and determining the first dirtiness degree corresponding to the preset cleaning region based on the mopping member dirtiness degree. Typically, when the mopping member dirtiness degree is less than the maximum dirt value d_max of the mopping member, the first dirtiness degree corresponding to the preset cleaning region is positively correlated with the mopping member dirtiness degree. That is, the greater the mopping member dirtiness degree, the dirtier the preset cleaning region. When the mopping member dirtiness degree is equal to the maximum dirt value d_max of the mopping member, it can be determined that the preset cleaning region is very dirty, and there will be still dirt left in the preset cleaning region after step S110 is performed and the mopping of the preset cleaning region is completed.

Illustratively, the obtaining the mopping member dirtiness degree of the mopping member includes: obtaining a detection value of sewage generated by cleaning the mopping member while cleaning the mopping member; and determining the mopping member dirtiness degree based on the detection value. In some embodiments, the dirt detection apparatus includes a sewage detection sensor which is configured to detect, for example, one or more of turbidity, chroma, and water conductivity of the sewage generated by cleaning the mopping member. The turbidity, the chroma, or the water conductivity of the sewage is configured to determine a dirt amount cleaned from the mopping member. The larger the turbidity, the chroma or the water conductivity of the sewage, the dirtier the sewage generated by cleaning the mopping member, and the greater the dirt amount cleaned from the mopping member, namely, the greater the dirt elution value which is for characterizing the dirt amount cleaned from the mopping member, and it also can be determined the greater the dirt amount adhering to the mopping member before the mopping member is cleaned and the larger the mopping member dirtiness degree. It should be understood that any one of the turbidity, the chroma, and the water conductivity of the sewage can be configured to characterize the dirt amount cleaned from the mopping member, namely the mopping member dirtiness degree. Each of the turbidity, the chroma, and the water conductivity of the sewage has a positive correlation or corresponding relationship with the dirt elution value, the dirt amount, or the mopping member dirtiness degree. For example, the turbidity of the sewage generated during a first-time cleaning of the mopping member is 1NTU, and a corresponding dirt elution value or dirt amount is 100; the turbidity of the sewage generated during a second time cleaning of the mopping member is 2NTU, and a corresponding dirt elution value or dirt amount is 200. As such, it can be determined that the dirt amount cleaned from the mopping member in the first time is less than the dirt amount cleaned from the mopping member in the second time. That is, the dirt elution value in the first-time cleaning is less than the dirt elution value in the second time cleaning. The corresponding relationship between the chroma or the water conductivity of the sewage and the dirt elution value or the dirt amount is similar, which is not detailed herein. It should be understood that the mopping member dirtiness degree may be characterized by way of a numerical value, such as any one of the turbidity of the sewage, the chroma of the sewage, the water conductivity of the sewage, the dirt amount, and the dirt elution value; or, the mopping member dirtiness degree may be determined by any one of the turbidity of the sewage, the chroma of the sewage, the water conductivity of the sewage, the dirt amount, and the dirt elution value. For example, if the turbidity of the sewage generated by cleaning the mopping member is 1NTU, the mopping member dirtiness degree of the mopping member may be characterized by 1; or, if the turbidity of the sewage generated by cleaning the mopping member is 1NTU and the corresponding dirtiness degree is 100, the mopping member dirtiness degree is 100.

Typically, the mopping member dirtiness degree of the mopping member is obtained by the dirt detection apparatus arranged on the base station, such as a vision sensor. For example, the darker the mopping member 110, the greater the mopping member dirtiness degree. The present disclosure is certainly not limited thereto. For another example, the mopping member dirtiness degree may be obtained by a vision sensor which is mounted on the cleaning robot and faces a mopping surface of the mopping member.

Illustratively, the obtaining the mopping member dirtiness degree of the mopping member includes: obtaining, when cleaning the mopping member, a detection value of sewage generated by cleaning the mopping member; and determining the mopping member dirtiness degree of the mopping member based on the detection value. In some embodiments, the dirt detection apparatus includes a sewage detection sensor, which is configured to detect, for example, one or more of turbidity, chroma, and water conductivity of the sewage generated by cleaning the mopping member. The greater the turbidity, the chroma or the water conductivity of the sewage, the dirtier the sewage after cleaning the mopping member, the greater the dirt amount cleaned from the mopping member (namely, the dirt elution value), and it also can be determined the greater the dirt amount adhering to the mopping member before the mopping member is cleaned, and the larger the mopping member dirtiness degree.

For example, during the cleaning of the mopping member, the detection values of the sewage detection sensor may be obtained at intervals. According to the time and/or an amount of water consumed for cleaning the mopping member, each the dirt amount corresponding to a detection value is accumulated, to obtain an accumulated result d of the dirt amount. The amount of water may be determined according to an amount of the cleaning water supplied to the cleaning sink and/or an amount of the sewage discharged.

In some embodiments, a mopping member cleaning operation performed between two floor cleaning operations may be viewed as one mopping member cleaning task. The mopping member cleaning task for cleaning the mopping member may include, for example, the process in which the mopping member is cleaned after cleaning one preset cleaning region and before cleaning another preset cleaning region, and may also include the process in which the mopping member is cleaned after finishing the cleaning task of the cleaning task map. For example, when the dirtiness degrees of all the regions in the cleaning task map are less than the corresponding dirt amount threshold, the mopping member cleaning task will be executed after ending the cleaning task.

The mopping member cleaning task for cleaning the mopping member includes one or more stage tasks. In each stage task, cleaning water is supplied to the cleaning sink of the base station to clean the mopping member, and then the sewage generated after cleaning the mopping member is discharged. This process may not be repeated or may be repeated multiple times. Alternatively, cleaning water supplying to the cleaning sink to clean the mopping member and sewage discharging are simultaneously performed. The present disclosure is certainly not limited thereto. For example, during the supply of the cleaning water to the cleaning sink, the sewage generated by cleaning the mopping member is intermittently discharged.

The time and/or the amounts of water consumed for cleaning the mopping member corresponding to different stage tasks may be the same or different. According to the time and/or the amounts of water corresponding to one or more stage tasks in the mopping member cleaning task, the dirt amount corresponding to the detection value obtained during the execution of each stage task is accumulated to obtain the accumulated result d of the dirt amount.

In some embodiments, the detection value, such as the turbidity of the sewage, is directly used as the dirt amount. The mopping member dirtiness degree is determined based on the accumulated result of the dirt amount. For example, the mopping member dirtiness degree d, namely the accumulated result of the dirt amount, may be obtained by integrating the turbidity T of the sewage over the amount of water l consumed for cleaning the mopping member, which is expressed as follows:

$$d=\int T dl$$

When the sewage detection sensor has a limit on water volume of detection and a limit on frequency of detection, the accumulated result d of the dirt amount may be determined according to the detection values obtained in one or more sampling operations and the amounts of water between sampling intervals, which is expressed as follows:

$$d=\Sigma T_i \times l_i$$

Wherein $T_i$ represents the turbidity T of the sewage at the $i^{th}$ sampling operation, $l_i$ represents the amount of water between two sampling operations, i is any number of 1, 2, . . . , and n, and n is a total number of the sampling operations.

For example, the mopping member dirtiness degree of the mopping member may be pre-judged according to a single detection value. For example, after stopping supplying cleaning water to the cleaning sink, the sewage is discharged, and the turbidity of the sewage is detected once when discharging the sewage and the discharged amount of the sewage is obtained, and the turbidity of the sewage and the amount of the sewage are multiplied to obtain the accumulated result d of the dirt amount. The present disclosure is certainly not limited thereto. For example, when discharging the sewage, the sewage may be detected multiple times to obtain multiple turbidity values, and an average value, a maximum value, or a minimum value of the multiple turbidity values is multiplied to the amount of the sewage to obtain the accumulated result d of the dirt amounts.

In some embodiments, the dirt amounts corresponding to different detection values are accumulated according to a time and/or an amount of water consumed for cleaning the mopping member. The accumulated result of the dirt amounts represents the dirt amount cleaned from the mopping member, which may be called the dirt elution value.

In some embodiments, the dirt elution value may be determined based on one or more dirt elution values in one or more stage tasks in the mopping member cleaning task. For example, the dirt elution values in all stage tasks are accumulated to obtain the dirt elution value in the mopping member cleaning task.

In each stage task, only one detection value of the sewage is obtained, or multiple detection values of the sewage are obtained, and the dirt elution value in the stage task is determined according to the one or more detection values. For example, the dirt elution value in the stage task is determined based on the product of an average value of the multiple detection values and the amount of water used in the stage task.

Typically, the mopping member dirtiness degree of the mopping member may be determined according to the dirt elution values in one or more stage tasks, or the dirt elution value in the mopping member cleaning task. For example, the mopping member dirtiness degree of the mopping member is determined based on a dirt elution value in the first stage task in the mopping member cleaning task. The greater the dirt elution value in the first stage task, the greater the mopping member dirtiness degree. Or, the mopping member dirtiness degree of the mopping member is determined based on a maximum value or an average value of the dirt elution values in multiple stage tasks. The greater the maximum value or the average value, the greater the mopping member dirtiness degree. The present disclosure is certainly not limited thereto. For example, the mopping member dirtiness degree may be predicted based on the dirt elution value in each stage task of multiple stage tasks by way of a prediction model. The prediction model may be obtained by fitting the number of stage tasks and the dirt elution value of each stage task in the mopping member cleaning task in the big data burial point. For example, the mopping member dirtiness degree is $T=f(t)$, where t represents a matrix of n×[order identifier, dirt elution value], n represents the quantity of stage tasks in the mopping member cleaning task, and the [order identifier, dirt elution value] represents the dirt elution values corresponding to the stage tasks executed in a certain order. For example, when the order identifier corresponds to the first stage task, the dirt elution value is the dirt elution value of the first stage task; and when the order identifier corresponds to the second stage task, the dirt elution value is the dirt elution value of the second stage task, and so on.

Typically, the mopping member dirtiness degree of the mopping member may be determined according to the dirt elution value of the executed stage task.

Illustratively, the obtaining a first dirtiness degree corresponding to a preset cleaning region includes: executing a mopping member cleaning task after the cleaning robot has completed mopping of the preset cleaning region with the mopping member, accumulating the dirt elution values of all of the stage tasks in the mopping member cleaning task to obtain the dirt elution value of the mopping member cleaning task, and determining the dirt elution value of the mopping member cleaning task as the first dirtiness degree corresponding to the preset cleaning region.

Step S130, determine that the preset cleaning region includes a target region according to the first dirtiness degree, the target region being a region that needs to be repeatedly mopped.

In this embodiment, whether the preset cleaning region includes a target region is determined according to the first dirtiness degree. Illustratively, according to the first dirtiness degree, the entire preset cleaning region may be considered as the target region, or part of the preset cleaning region is considered as the target region. For example, when the first dirtiness degree of the preset cleaning region is acquired by means of a vision sensor, it is possible to determine the distribution of the dirtiness degree of different regions in the preset cleaning region, based on the distribution of the dirtiness degree of different regions in the preset cleaning region, to determine that the dirtier region among them is the target region.

When the preset cleaning region is determined to be very dirty according to the first dirtiness degree corresponding to the preset cleaning region, the preset cleaning region is determined to include the target region. In some embodiments, before mopping the preset cleaning region at step S110, when mopping the preset cleaning region at step S110, or after mopping the preset cleaning region at step S110, the first dirtiness degree corresponding to the preset cleaning region is obtained, and whether the preset cleaning region includes the target region is determined.

For the purpose of illustration, the embodiments of the present disclosure are mainly illustrated by determining the first dirtiness degree of the preset cleaning region according to the mopping member dirtiness degree after mopping the preset cleaning region at step S110, and determining whether the preset cleaning region includes the target region according to the first dirtiness degree.

In some embodiments, when the first dirtiness degree corresponding to the preset cleaning region is greater than or equal to a preset dirt amount threshold, the preset cleaning region is determined to include the target region; and/or when the first dirtiness degree corresponding to the preset cleaning region is less than the preset dirt amount threshold, the preset cleaning region is determined to include no target region.

Typically, the dirt amount threshold may be determined according to the maximum dirt value d_max of the mopping member. For example, the dirt amount threshold is positively correlated with the maximum dirt value d_max of the mopping member.

Illustratively, the total dirt amount of the preset cleaning region being currently mopped by the cleaning robot is set as V. When V is greater than the maximum dirt value d_max of the mopping member, the accumulated dirt amount d of the mopping member during mopping the preset cleaning region will be approximately equal to the maximum dirt value d_max, so a total remaining dirt amount on the preset cleaning region is V−d=V−d_max>0, which indicates that the preset cleaning region is not fully cleaned. When V is less than or equal to the maximum dirt value d_max of the mopping member, the accumulated dirt amount d of the mopping member during mopping the preset cleaning region will be approximately equal to V, so a total remaining dirt amount on the preset cleaning region is V−d=0, which indicates that the preset cleaning region is fully cleaned.

Typically, the dirt amount threshold is less than or equal to the maximum dirt value d_max of the mopping member. In actual use, it is difficult for the mopping member to collect as much dirt amount as the maximum dirt value d_max. Therefore, the dirt amount threshold can be less than the maximum dirt value d_max.

In some embodiments, the dirt amount threshold may be determined according to the cleaning mode (or called a mopping mode) of the cleaning robot. For example, the higher the cleaning requirement of the cleaning mode (e.g., deep cleaning mode), the smaller the dirt amount threshold, and the lower the cleaning requirement of the cleaning mode (e.g., fast cleaning mode), the larger the dirt amount threshold. For example, the dirt amount threshold d_var is equal to k×d_max (d_var=k×d_max), where 0<k<1. For different cleaning modes, different values of k may be selected. For example, the value of k set for the deep cleaning mode may be smaller, while the value of k set for the fast cleaning mode may be larger. The cleaning robot may include a fast cleaning mode, a normal cleaning mode, a deep cleaning mode, and other modes, and different cleaning modes correspond to different dirt amount thresholds. For example, when the normal cleaning mode having a dirt amount threshold 20 is selected, if the first dirtiness degree of the preset cleaning region is greater than 20, then the preset cleaning region is repeatedly cleaned; if the first dirtiness degree is less than 20, then the cleaning of the preset cleaning region is stopped. When the deep cleaning mode having a dirt amount threshold 10 is selected, if the first dirtiness degree of the preset cleaning region is greater than 10, then the preset cleaning region is repeatedly cleaned; if the first dirtiness degree is less than 10, then the cleaning of the preset cleaning region is stopped.

When the first dirtiness degree corresponding to the preset cleaning region is certain (such as 15), the first dirtiness degree is greater than or equal to the dirt amount threshold (e.g., 10 for the deep cleaning mode) and the preset cleaning region is determined to include the target region in the more demanding cleaning mode. When the first dirtiness degree is less than the dirt amount threshold (e.g., 20 for the fast cleaning mode), the preset cleaning region is determined to not include the target region in the less demanding cleaning mode. Therefore, in the more demanding cleaning mode, at least part of the preset cleaning region can be mopped repeatedly to achieve a deep cleaning of the floor.

It should be noted that the cleaning modes in the related art are only defined according to the difference of the number of times the floor is mopped, such as fast cleaning mode which means cleaning (mopping) once and deep cleaning mode which means cleaning (mopping) twice. This kind of defined mode is less efficient and may waste unnecessary time. For example, if the region is clean but user sets the cleaning mode to deep cleaning, the floor needs to be cleaned twice, so the cleaning efficiency is low.

The embodiments of the present disclosure can improve cleaning efficiency by adjusting the dirt amount threshold according to the cleaning mode of the cleaning robot to determine whether the preset cleaning region needs to be repeatedly mopped based on the comparison of the dirt amount threshold and the first dirtiness degree of the preset cleaning region. For example, when the preset cleaning region is clean but user sets the cleaning mode to deep cleaning, the preset cleaning region is cleaned only once, so the cleaning efficiency is higher.

Step S140, control the cleaning robot to mop at least part of the target region by the mopping member after mopping of the preset cleaning region has been completed and after maintenance of the mopping member.

In some embodiments, if the preset cleaning region is determined to include the target region at step S130, then the cleaning robot is controlled to move to the base station to allow the mopping member being maintained after finishing the mopping of the preset cleaning region, such as replacing or cleaning the mopping member. The mopping member may include at least one of the following: a spin mop, a one-piece mop, a roller mop, a crawler mop, and the like, but is certainly not limited thereto. It should be noted that the maintenance for the mopping member is not limited to being performed by the base station, or by the cleaning robot, or by both the base station and the cleaning robot, but can also be notified to user and performed by the user.

In some embodiments, when the mopping of the preset cleaning region is completed and when performing the mopping member cleaning task, the mopping member dirtiness degree of the mopping member is obtained and the first dirtiness degree of the preset cleaning region is determined according to the mopping member dirtiness degree, and if the preset cleaning region includes a target region, then after finishing the mopping member cleaning task, the cleaning robot may be controlled to mop at least part of the target region by the mopping member.

Typically, the dirt amount adhering to the mopping member is the dirt amount picked up from the preset cleaning region, that is, the mopping member dirtiness degree can be used to represent the dirtiness degree of the preset cleaning region. During the execution of a mopping member cleaning task, when the mopping member dirtiness degree is greater than or equal to the preset dirt amount threshold, after the mopping member cleaning task is finished, the cleaning robot is controlled to mop the target region with the cleaned mopping member. The target region is the region which has been cleaned by the mopping member before performing the mopping member cleaning task. For example, the mopping member dirtiness degree is determined according to the dirt elution value in at least the first stage task in the mopping member cleaning task, when the mopping member dirtiness degree is greater than or equal to the preset dirt amount threshold, it can be determined that the mopped region includes the target region, then the mopping member cleaning task can be ended after the at least first stage task. After the at least first stage task, the mopping member has been cleaned to some extent and has the ability to adhere dirt, therefore, without the subsequent stage tasks, the mopping member can still provide a noticeable cleaning effect when repeatedly mopping the target region, which reduces the time of cleaning the mopping member as well as the amount of water consumed.

An embodiment of the present disclosure further provides a cleaning method for a mopping member. The cleaning method may be applied to a cleaning system to control a base station and/or a cleaning robot in the cleaning system, so as to control a cleaning mechanism on the base station and/or a cleaning mechanism on the cleaning robot to clean the mopping member of the cleaning robot.

Continuing to refer to FIG. 2, the cleaning system further includes a control apparatus 300 which is configured to implement the steps of the controlling method for the cleaning robot and/or the steps of the cleaning method for the mopping member. In some embodiments, the robot controller 104 of the cleaning robot 100 and/or the base station controller 206 of the base station 200 may be used alone or in combination as the control apparatus 300 to implement the steps of the method in the embodiments of the present disclosure. In other embodiments, the cleaning system includes a separate control apparatus 300 to implement the steps of the method of the embodiments of the present disclosure. The control apparatus 300 may be arranged on the cleaning robot 100 or on the base station 200, which is not limited thereto. For example, the control apparatus 300 may be an apparatus other than the cleaning robot 100 and the base station 200, such as a home intelligent terminal, a general control apparatus, and the like. In some embodiments, the robot controller 104 is configured to implement the steps of the controlling method for the cleaning robot in the embodiments of the present disclosure, and the base station controller 206 is configured to implement the steps of the cleaning method for the mopping member in the embodiments of the present disclosure. The present disclosure is certainly not limited thereto.

The inventors of the present disclosure found that although some devices in the related art can clean the mopping member, but in order to ensure that the mopping member such as the mop is washed clean, the cleaning time is usually fixed for a long time, which affects the efficiency of the cleaning robot and wastes more water.

In view of this, the present disclosure makes improvement to the cleaning method for the mopping member, so as to enhance the cleaning efficiency of the mopping member, for example by cleaning the mopping member as soon as possible to control the cleaning robot to clean other preset cleaning regions or to mop the last cleaned region.

Figure 8:
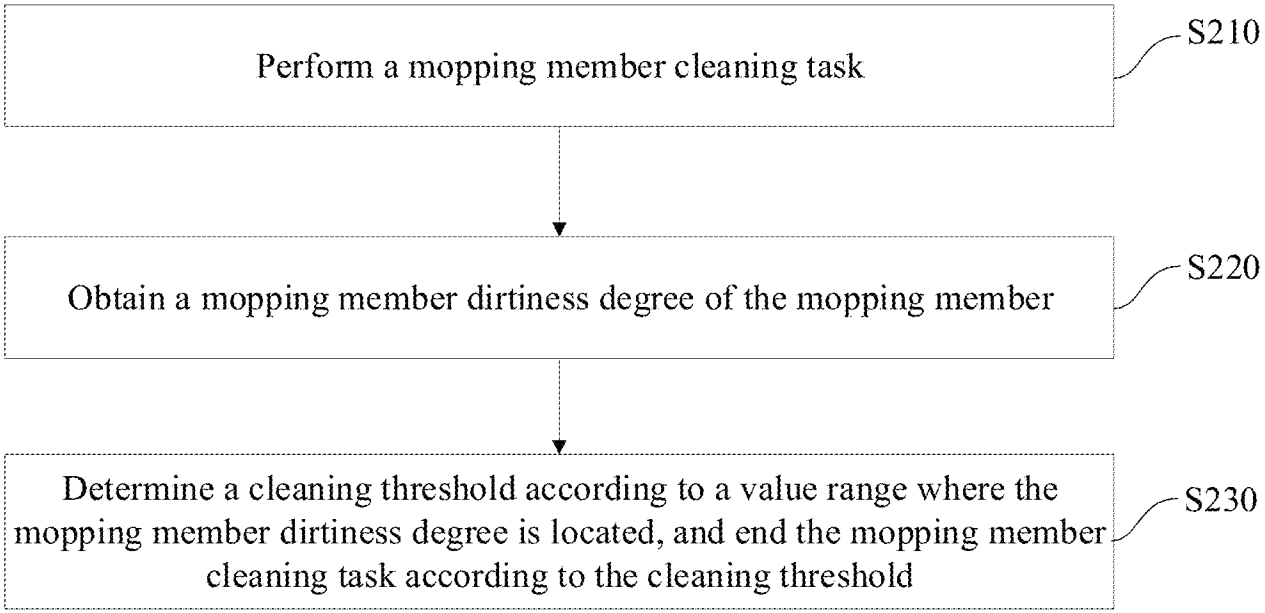
FIG. 8 is a schematic flowchart of a cleaning method for a mopping member according to an embodiment of the present disclosure.

As shown in FIG. 8, the cleaning method for the mopping member includes step S210 to step S230.

Step S210, perform a mopping member cleaning task.

Step S220, obtain a mopping member dirtiness degree of the mopping member.

It should be noted that the order of the step to perform the mopping member cleaning task and the step to acquire the mopping member dirtiness degree is not limited. For example, the mopping member cleaning task can be started after the mopping member dirtiness degree is obtained by a vision sensor or an infrared sensor, and the mopping member cleaning task can be ended according to a cleaning threshold corresponding to the mopping member dirtiness degree.

In some embodiments, after performing each stage task of the mopping member cleaning task, the mopping member dirtiness degree of the mopping member is determined according to the one or more dirt elution values of the one or more performed stage tasks.

In some embodiments, the mopping member cleaning task includes one or more performed stage tasks and one or more un-performed stage tasks. The one or more un-performed stage tasks are one or more other stage tasks which are followed by the one or more performed stage tasks. For example, the one or more performed stage tasks may include one or more stage tasks that have been performed in the mopping member cleaning task. The performed stage task may be called a historical stage task. Each stage task before a current stage task may be the performed stage task. The one or more un-performed stage tasks may include the current stage task, or may further include one or more to-be-performed stage tasks after the current stage task.

Illustratively, the step of acquiring the mopping member dirtiness degree of the mopping member includes: obtaining a mopping member dirtiness degree of the mopping member in the one or more performed stage tasks.

The mopping member dirtiness degree of the mopping member in the performed stage task may be obtained by a sensor, such as a vision sensor or an infrared sensor, or may be determined according to the dirt elution value during the cleaning of the mopping member in the performed stage task.

Typically, the obtaining the mopping member dirtiness degree in the one or more performed stage tasks includes: obtaining an image or color information of the mopping member by a vision sensor before the performed stage task, and determining the mopping member dirtiness degree in the performed stage task according to the image or color information of the mopping member. For example, after acquiring the image or color information of the mopping member by means of the vision sensor and determining the mopping member dirtiness degree of the mopping member based on the image or color information of the mopping member, the stage task is performed.

Illustratively, the obtaining the mopping member dirtiness degree of the mopping member in the one or more performed stage tasks includes: obtaining the dirt elution value of the mopping member in the one or more performed stage tasks; and determining the mopping member dirtiness degree according to the dirt elution value in the one or more performed stage tasks. Typically, based on a preset correspondence or model between the mopping member dirtiness degree and the dirt elution value of the one or more performed stage tasks, the mopping member dirtiness degree is determined according to the dirt elution value of the one or more performed stage tasks. For example, the greater the dirt elution value of the one or more performed stage tasks, the greater the mopping member dirtiness degree.

In some embodiments, the mopping member dirtiness degree is determined according to the dirt elution value in the first stage task of the mopping member cleaning task. For example, the mopping member dirtiness degree is determined based on the dirt elution value in the first stage task of the mopping member cleaning task. Generally, the dirt elution amount in the first stage task is the largest. The greater the mopping member dirtiness degree, the greater the dirt elution amount in the first stage task. The mopping member dirtiness degree can be quickly determined according to the dirt elution value in the first stage task.

In some embodiments, the mopping member dirtiness degree is determined according to the dirt elution value in the latest performed stage task before the one or more un-performed stage tasks. For example, when the un-performed stage task is the second stage task of the mopping member cleaning task, the mopping member dirtiness degree is determined according to the dirt elution value in the first stage task of the mopping member cleaning task. When the un-performed stage task is the $i^{th}$ stage task of the mopping member cleaning task, the mopping member dirtiness degree is determined according to the dirt elution value in the $(i-1)^{th}$ stage task of the mopping member cleaning task, where i is an integer greater than 1. The larger the latest dirt elution value, the greater the mopping member dirtiness degree.

In some embodiments, the mopping member dirtiness degree is determined according to the dirt elution values in multiple performed stage tasks before the one or more un-performed stage tasks, such as at least one of the following: an accumulated value, a maximum value, and an average value of the dirt elution values of the plurality of performed stage tasks. The present disclosure is certainly not limited thereto. For example, the mopping member dirtiness degree may be determined according to the dirt elution values of the plurality of performed stage tasks, based on a prediction model. For example, when the un-performed stage task is the $i^{th}$ stage task, the mopping member dirtiness degree is determined according to an accumulated value of dirt elution values of a plurality of performed stage tasks (for example, the first stage task to the $(i-1)^{th}$ stage task), thereby the mopping member dirtiness degree can be determined more accurately.

Step S230, determine a cleaning threshold according to a value range where the mopping member dirtiness degree is located, and end the mopping member cleaning task according to the cleaning threshold.

In some embodiments, when a current dirtiness degree of the mopping member is determined to be lower than the cleaning threshold at the end of a certain stage task, it can be determined that the mopping member has been cleaned to meet a requirement, then the cleaning of the mopping member can be ended, and the mopping member, for example, can be used to mop the preset cleaning region.

Typically, the current dirtiness degree of the mopping member may be acquired by a vision sensor or an infrared sensor.

Typically, the current dirtiness degree of the mopping member may be determined according to the dirt elution value during the cleaning of the mopping member in a current stage task. The smaller the dirt elution value, the smaller the current dirtiness degree of the mopping member, namely, the cleaner the mopping member. Typically, when the dirt elution value of the mopping member in the current stage task is less than or equal to the cleaning threshold, then the mopping member cleaning task is ended. That is, the current stage task is the last stage task of the mopping member cleaning task.

Illustratively, the corresponding cleaning threshold is determined according to a value range where the mopping member dirtiness degree is located, based on a corresponding relationship or model, such as a function relationship, between a preset cleaning threshold and the value range where the mopping member dirtiness degree is located.

In some embodiments, the cleaning threshold has a positive correlation with an upper limit value of the value range where the mopping member dirtiness degree is located, or has a positive correlation with a lower limit value of the value range. For example, the larger the upper limit value of the value range where the mopping member dirtiness degree is located, the larger the cleaning threshold. When the mopping member dirtiness degree is relatively high, it indicates that the mopped floor is relatively dirty, by cleaning the mopping member to be generally clean, namely ending the mopping member cleaning task at a relatively large cleaning threshold, time and water consumption for cleaning the mopping member can be reduced; and in addition, the mopping member can still provide a noticeable cleaning effect to the dirty floor.

The mopping member dirtiness degree is related to the dirtiness degree of the floor that has been mopped by the mopping member, such as the first dirtiness degree of a preset cleaning region. When the mopping member dirtiness degree is relatively large, it indicates that the mopped floor is relatively dirty. In the situation the floor needs to be repeatedly mopped, if the mopping member is cleaned to be very clean and then repeatedly mop the floor, the cleaning effect of the mopping member providing to the floor is comparable to the cleaning effect of cleaning the mopping member to generally clean and then repeatedly mopping the floor, but the water and time consumed for cleaning the mopping member to be very clean are quite different from those consumed for cleaning the mopping member to be generally clean. Therefore, when the floor needs to be repeatedly mopped, the benefit of cleaning the mopping member to be very clean is smaller than the benefit of cleaning the mopping member to be generally clean, the former of which affects the working efficiency of the cleaning robot and wates more water.

In some other embodiments, the cleaning threshold has a negative correlation with the upper limit value of the value range where the mopping member dirtiness degree is located, or has a negative correlation with the lower limit value of the value range. That is, the greater the value range where the mopping member dirtiness degree is located, the smaller the cleaning threshold. When the mopping member dirtiness degree is relatively large, it indicates that the mopped floor is relatively dirty. By cleaning the mopping member to a cleaner state, the cleaned mopping member can pick up more dirt when mopping the floor, for example, the number of times for mopping the floor can be reduced, thus improving the cleaning robot's work efficiency and improving the cleaning efficiency of the floor. In addition, the number of times that the cleaning robot returns to the base station for cleaning after mopping the floor can be reduced, thereby reducing the round-trip time and the amount of water consumed for cleaning the mopping member.

In some embodiments, the cleaning threshold may be adjusted according to an area of a to-be-mopped region in the cleaning task. Illustratively, the cleaning threshold is positively correlated with the area of the to-be-mopped region. For example, when the area of the to-be-mopped region is large, the water consumption of the base station can be prevented from running out before the to-be-mopped region is completely cleaned by heightening the cleaning threshold.

According to the cleaning method for the mopping member provided by the embodiments of the present disclosure, the cleaning threshold is determined according to the value range where the mopping member dirtiness degree is located, and the mopping member cleaning task is ended in time according to the cleaning threshold. The mopping member dirtiness degree can reflect the dirtiness degree of the floor, so that the cleaning degree of the mopping member can be adjusted according to the dirtiness degree of the floor, thereby improving the work efficiency of the cleaning robot.

In some embodiments, the determining the cleaning threshold according to the value range where the mopping member dirtiness degree is located and ending the mopping member cleaning task according to the cleaning threshold includes: determining a cleaning threshold of the one or more un-performed stage tasks according to the value range where the mopping member dirtiness degree in the one or more performed stage tasks is located; obtaining the mopping member dirtiness degree in the one or more un-performed stage tasks; and ending the mopping member cleaning task upon determining that the mopping member dirtiness degree in the one or more un-performed stage tasks is less than or equal to the cleaning threshold of the one or more un-performed stage tasks.

Typically, the mopping member dirtiness degree of the mopping member in the one or more un-performed stage tasks may be acquired by a sensor, such as a vision sensor or an infrared sensor, or may be determined according to the dirt elution value when cleaning the mopping member in the one or more un-performed stage tasks. For example, the obtaining the mopping member dirtiness degree of the mopping member in the one or more un-performed stage tasks, and ending the mopping member cleaning task upon determining that the mopping member dirtiness degree in the one or more un-performed stage tasks is less than or equal to the cleaning threshold of the one or more un-performed stage tasks includes: obtaining the dirt elution value of the mopping member in the one or more un-performed stage tasks, and ending the mopping member cleaning task when the dirt elution value of the mopping member in the one or more un-performed stage tasks is less than or equal to the cleaning threshold of the one or more un-performed stage tasks.

In some embodiments, the mopping member dirtiness degree is determined according to one or more dirt elution values in one or more performed stage tasks after ending the latest performed stage task. For example, the mopping member dirtiness degree is determined according to an accumulated value of dirt elution values in multiple performed stage tasks or a predicted value; the cleaning threshold of the one or more un-performed stage tasks is determined according to the mopping member dirtiness degree; the dirt elution value in the un-performed stage task is obtained when cleaning the mopping member in the un-performed stage task; and the mopping member cleaning task is ended when the dirt elution value in the un-performed stage task is less than or equal to the cleaning threshold. That is, the un-performed stage task is the last stage task of the mopping member cleaning task.

In some embodiments, the mopping member dirtiness degree may be determined according to the dirt elution value in at least one performed stage task before the un-performed stage task, and the cleaning threshold of the un-performed stage task may be determined according to the mopping member dirtiness degree. For example, when the dirt elution value in the un-performed stage task is greater than the cleaning threshold of the un-performed stage task, the un-performed stage task is taken as a performed stage task, and the dirt elution value in this stage task is accumulated to the mopping member dirtiness degree to obtain an updated mopping member dirtiness degree. Then, the cleaning threshold of the un-performed stage task is updated according to the updated mopping member dirtiness degree. After that, continue to clean the mopping member in the new un-performed stage task, and compare the dirt elution value in the new un-performed stage task with the updated cleaning threshold; and end the mopping member cleaning task until the dirt elution value in a certain stage task is less than or equal to the cleaning threshold of that stage task.

In some embodiments, when the dirt elution value in the un-performed stage task is greater than the cleaning threshold of the un-performed stage task, then the cleaning of the mopping member continues in a new un-performed stage task, and the dirt elution value in the new un-performed stage task is compared with the cleaning threshold, and the mopping member cleaning task is not ended until the dirt elution value in a certain stage task is less than or equal to the cleaning threshold of that stage task. It should be understood that it is also possible to determine the cleaning threshold only once, and in the subsequent stage tasks, the dirt elution value in each stage task is compared with this cleaning threshold. For example, after ending the first stage task, the cleaning threshold is determined according to the dirt elution value in the first stage task, and in the subsequent stage tasks, the dirt elution value in each stage task is compared with this cleaning threshold.

Typically, there are a plurality of value ranges which are different from each other. For example, there is no overlap between these value ranges, and each of the cleaning thresholds corresponding to each of these value ranges is different from the others. For example, there are at least a first value range and a second value range, and the two of which are different from each other. The determining the cleaning threshold of the one or more un-performed stage tasks according to the value range where the mopping member dirtiness degree in the one or more performed stage tasks is located includes: determining the cleaning threshold of the one or more un-performed stage tasks to be a first cleaning threshold when the mopping member dirtiness degree is within the first value range; and determining the cleaning threshold of the one or more un-performed stage tasks to be a second cleaning threshold when the mopping member dirtiness degree is within the second value range. The first cleaning threshold is not equal to the second cleaning threshold. For example, when the values within the first value range are all greater than the values within the second value range, the first cleaning threshold is greater than the second cleaning threshold. That is, the cleaning threshold is positively correlated with the upper limit value of the value range where the mopping member dirtiness degree is located or positively correlated with the lower limit value of the value range. The present disclosure is certainly not limited thereto. For example, when the values within the first value range are all less than the values within the second value range, the first cleaning threshold can also be greater than the second cleaning threshold. That is, the cleaning threshold is negatively correlated with the upper limit of the value range where the mopping member dirtiness degree is located or negatively correlated with the lower limit of the value range.

Illustratively, as shown in FIG. 9, there are three value ranges corresponding to the mopping member dirtiness degree. The mopping member dirtiness degree falling within the first value range is less than the second dirt amount threshold, and the cleaning threshold corresponding to the first value range is a $0^{th}$ threshold. The mopping member dirtiness degree falling within the second value range is greater than or equal to the second dirt amount threshold and less than the first dirt amount threshold, and the cleaning threshold corresponding to the second value range is a $1^{st}$ threshold. The mopping member dirtiness degree falling within the third value range is greater than or equal to the first dirt amount threshold, and the cleaning threshold corresponding to the third value range is a $2^{nd}$ threshold. The present disclosure is certainly not limited thereto. The $2^{nd}$ threshold is greater than the $1^{st}$ threshold, and the $1^{st}$ threshold is greater than the $0^{th}$ threshold. For example, when the mopping member dirtiness degree is large, the mopped floor can be determined to be dirty, the cleaning of the mopping member may be ended after a few times of cleaning according to a large cleaning threshold.

Referring to FIG. 9, the floor mopped by the mopping member may be determined to include the target region when the mopping member dirtiness degree is greater than or equal to a preset dirt amount threshold, such as the second dirt amount threshold. After the mopping member cleaning task is ended, at least part of the target region is repeatedly mopped (which may be called mopping again).

In some embodiments, the cleaning method further includes: determining a cleaning strategy of the one or more un-performed stage tasks according to the dirt elution value in the one or more performed stage tasks. For example, the cleaning duration and/or the amount of water for the one or more un-performed stage tasks may be determined according to the dirt elution value in the one or more performed stage tasks. The present disclosure is certainly not limited thereto. For example, a rotation speed of the pump that supplies cleaning water to the cleaning sink can be adjusted to increase or decrease the pressure of the water supplied to the mopping member.

In some embodiments, the cleaning duration and/or the amount of water for one or more un-performed stage tasks are positively correlated with the dirt elution value in the one or more performed stage tasks. When the dirt elution value in the one or more performed stage tasks is large, it can be determined that there is a lot of dirt adhering to the mopping member. In this case, by increasing the cleaning duration and/or the amount of water for the one or more un-performed stage tasks, more dirt can be removed in the one or more un-performed stage tasks, thereby improving the cleaning efficiency. When the dirt elution value in the one or more performed stage tasks is small, it can be determined that there is a relatively small amount of dirt adhering to the mopping member. In this case, by decreasing the cleaning duration and/or the amount of water for the one or more un-performed stage tasks, time and water can be saved.

For example, after one preset cleaning region is mopped, the cleaning robot moves to the base station to clean the mopping member. The first stage task is to clean the mopping member for 15 seconds. The mopping member dirtiness degree is determined according to the dirt elution value in the first stage task, and the cleaning threshold is determined according to the value range where the mopping member dirtiness degree is located. When the dirt elution value in the first stage task is greater than the cleaning threshold, according to the dirt elution value in the first stage task, the cleaning duration (such as 18 seconds) and/or the amount of water of the one or more un-performed stage tasks are determined. Then, the second stage task is performed, in which the mopping member is cleaned for 18 seconds. By increasing the cleaning duration of the one or more un-performed stage tasks, the number of the subsequent un-performed stage tasks is reduced, thereby improving the cleaning efficiency.

Typically, after the mopping member cleaning task is ended, the mopping member dirtiness degree (for example, determined according to an accumulated value of dirt elution values of all the stage tasks in the mopping member cleaning task) and the first dirtiness degree corresponding to the preset cleaning region may be determined according to the dirt elution value in at least one stage task in the mopping member cleaning task, and the first dirtiness degree is configured to determine that the preset cleaning region includes the target region.

In some embodiments, the cleaning duration and/or the amount of water of the one or more un-performed stage tasks are negatively correlated with the dirt elution value in the one or more performed stage tasks. When the dirt elution value in the one or more performed stage tasks is large, by reducing the cleaning duration and/or the amount of water for the one or more un-performed stage tasks, or by increasing the number of the un-performed stage tasks, the mopping member can be fully cleaned to improving the overall cleaning efficiency of the dirty member. When the dirt elution value in the one or more performed stage tasks is small, by increasing the cleaning duration and/or the amount of water of the one or more un-performed stage tasks to take away more dirt in each un-performed stage task, the number of subsequent un-performed stage tasks is reduced. This allows fast and thorough cleaning of the mopping member, thereby improving the cleaning efficiency of the dirty member.

Typically, after determining the cleaning threshold of the one or more un-performed stage tasks according to the value range where the mopping member dirtiness degree of the one or more performed stage tasks is located, the cleaning strategy of the one or more un-performed stage tasks is determined according to the dirt elution value in the one or more performed stage tasks and the cleaning threshold of the one or more un-performed stage tasks.

Typically, the cleaning duration and/or the amount of water of the one or more un-performed stage tasks may be adjusted according to the dirt elution value in the one or more performed stage tasks and the cleaning threshold of the one or more un-performed stage tasks. For example, when the dirt elution value in the one or more performed stage tasks is less than or equal to the cleaning threshold, the mopping member cleaning task can be ended; and when the dirt elution value in the one or more performed stage task is greater than the cleaning threshold, the cleaning strategy for the one or more un-performed stage tasks is adjusted, such as adjusting the cleaning duration and/or the amount of water, and based on the cleaning duration and/or the amount of water for the one or more un-performed stage tasks, the one or more un-performed stage tasks are performed.

In some embodiments, the method further includes: ending the mopping member cleaning task and/or outputting a malfunction reminder when the amount of water consumed for cleaning the mopping member reaches a preset water amount threshold or the time consumed for cleaning the mopping member reaches a preset time threshold when performing the mopping member cleaning task. For example, when cleaning water is supplied to the cleaning sink from the clean water tank only, the amount of water that can be used to clean the mopping member is limited. When the amount of water consumed in a certain mopping member cleaning task reaches a preset water amount threshold or the time reaches a preset time threshold, the mopping member cleaning task will be ended in time to retain part of the cleaning water to clean the mopping member after the mopping member finishing mopping the floor, so as to prevent the water in the water tank from being depleted before the floor cleaning task is completed. Alternatively, a malfunction reminder is output to remind a user to add water to the water tank when the amount of water consumed by cleaning the mopping member reaches the preset water amount threshold or the time reaches the preset time threshold.

After the mopping member is maintained, the dirtiness degree of the mopping member of the cleaning robot satisfies a requirement, for example, the mopping member dirtiness degree is less than or equal to the corresponding cleaning threshold. Then the cleaning robot may be controlled to mop at least part of the target region through the mopping member and, after adhering the dirt amount of d_max in step S110, the mopping member continues to adhere the remaining dirt amount of V-d max on the target region, thereby improving the cleaning effect to the target region.

In some embodiments, there are a plurality of preset cleaning regions. When it is determined in step S130 that the current preset cleaning region includes the target region, the cleaning robot will be controlled to mop at least part of the target region through the mopping member after mopping of all the preset cleaning regions has been completed and the mopping member is maintained. In some embodiments, all the preset cleaning regions are all the preset cleaning regions in the cleaning task map.

Figure 10:
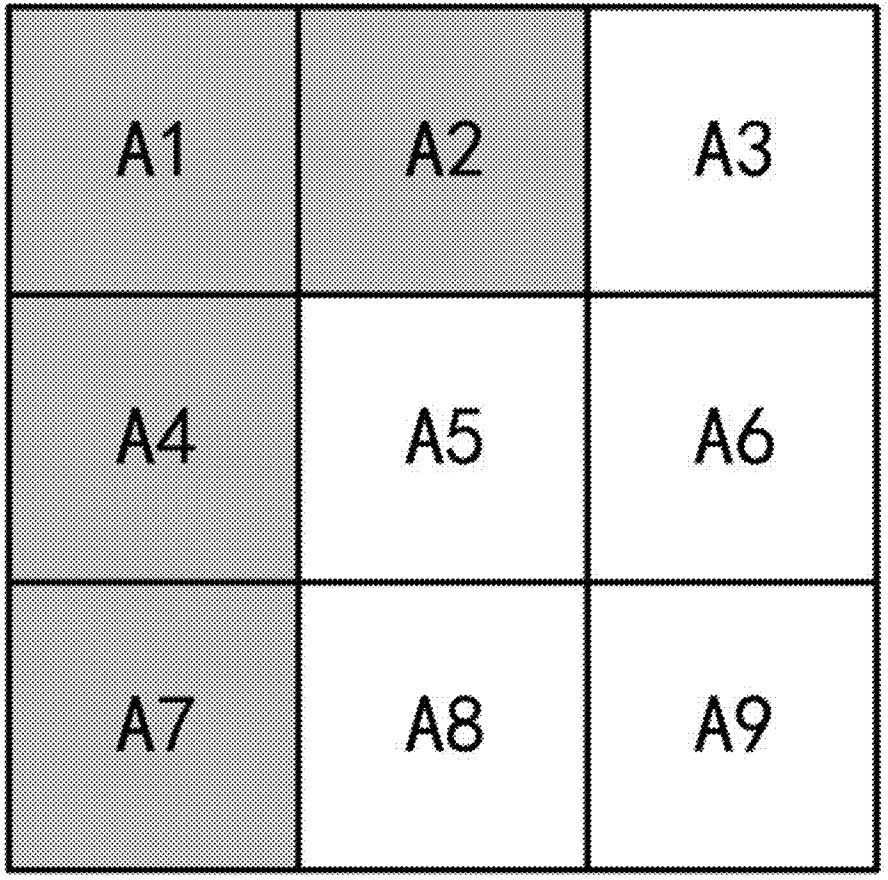
FIG. 10 is a schematic diagram of a plurality of preset cleaning regions according to an embodiment of the present disclosure.

For example, as shown in FIG. 10, there are a plurality of preset cleaning regions, including preset cleaning regions from A1 to A9. The cleaning sequence of the preset cleaning regions from A1 to A9 is, for example, A1, A2, . . . , and A9. After mopping the preset cleaning region A1, the preset cleaning region A1 is determined to include a target region and marked as including the target region. Then, after the mopping member is maintained, the preset cleaning regions from A2 to A9 are mopped according to the cleaning sequence. After mopping the preset cleaning region A2, the preset cleaning region A2 is determined to include a target region and marked as including the target region. After mopping the preset cleaning region A4, the preset cleaning region A4 is determined to include a target region. After mopping the preset cleaning region A7, the preset cleaning region A7 is determined to include a target region. As shown in FIG. 10, the gray regions represent the preset cleaning regions including the target regions.

After mopping of the preset cleaning region A9 has been completed and the mopping member is maintained, the cleaning robot is controlled to mop at least part of the target regions of the preset cleaning regions A1, A2, A4 and A7 through the mopping member. The at least part of the target regions are mopped after mopping of all the preset cleaning regions has been completed, so that all the preset cleaning regions in the cleaning task map can first be cleaned at least once. For example, when there are several preset cleaning regions in the cleaning task map that are dirty, the floor corresponding to the cleaning task map can get less dirty as soon as possible.

In some other embodiments, there are a plurality of preset cleaning regions. When it is determined in step S130 that the current preset cleaning region includes the target region, the mopping member is maintained and then the cleaning robot is controlled to mop at least part of the target region through the mopping member before the other preset cleaning regions are mopped.

Referring to FIG. 10, after the preset cleaning region A1 is mopped, the preset cleaning region A1 is determined to include a target region, and then after the mopping member is maintained, the mopping member mops at least part of the target region of the preset cleaning region A1, thereby allowing the preset cleaning region A1 to be clean as soon as possible. Then, the mopping member mops the preset cleaning regions from A2 to A9 according to the cleaning sequence. After the preset cleaning region A2 is mopped, the preset cleaning region A2 is determined to include a target region, and the mopping member, after being maintained, mops at least part of the target region of the preset cleaning region A2. After that, the preset cleaning region A3 is mopped. Illustratively, when there is a preset cleaning region that is relatively dirty in the cleaning task map, for example, the preset cleaning region is spilled with dirty liquid, then the preset cleaning region is cleaned first before the remaining preset cleaning regions are cleaned. In this way, the remaining preset cleaning regions are cleaned after cleaning the dirty preset cleaning region, so that even if the dirt adhering to the mopping member contaminates the remaining preset cleaning regions when the cleaning robot moves through these remaining preset cleaning regions towards the base station after repeatedly mopping the target region, the contamination can be cleaned off when cleaning these remaining preset cleaning regions.

In some other embodiments, there are a plurality of preset cleaning regions. When the first dirtiness degree of the current preset cleaning region is greater than or equal to a preset first dirt amount threshold, the current preset cleaning region is determined to include a target region. Then the mopping member is maintained and the cleaning robot is controlled to mop at least part of the target region through the maintained mopping member before mopping the other preset cleaning regions. That is, when the first dirtiness degree is greater than or equal to the preset first dirt amount threshold, the cleaning robot is immediately controlled to mop at least part of the target region by the mopping member. When the first dirtiness degree of the preset cleaning region is greater than or equal to a preset second dirt amount threshold and less than the preset first dirt amount threshold, the preset cleaning region is determined to include a target region, then the cleaning robot is controlled to mop at least part of the target region through the mopping member after mopping of all the preset cleaning regions has been completed and the mopping member is maintained. Referring to FIG. 9, the first dirtiness degree of the preset cleaning region is determined according to the mopping member dirtiness degree. When the first dirtiness degree of the preset cleaning region is greater than or equal to the preset first dirt amount threshold, the cleaning robot is immediately controlled to mop at least part of the target region by the mopping member. When the first dirtiness degree of the preset cleaning region is greater than or equal to the preset second dirt amount threshold and is less than the preset first dirt amount threshold, the cleaning robot is controlled to mop at least part of the target region through the mopping member after all the preset cleaning regions has been mopped once and the mopping member is maintained.

The second dirt amount threshold is less than the first dirt amount threshold. When the first dirtiness degree of the current preset cleaning region is greater than or equal to the first dirt amount threshold, it indicates that the preset cleaning region is very dirty, then at least part of the target region of the preset cleaning region can be cleaned multiple times to allow the at least part of the target region to be relatively clean (for example, allowing the dirtiness degree to be less than the first dirt amount threshold) or to be very clean (for example, allowing the dirtiness degree to be less than the second dirt amount threshold) as soon as possible before cleaning the remaining preset cleaning regions. In this way, even if the dirt adhering on the mopping member contaminates the remaining preset cleaning regions when the cleaning robot moves through these remaining preset cleaning regions towards the base station after repeatedly mopping the target region, the contamination can be cleaned off during cleaning these remaining preset cleaning regions. When the first dirtiness degree of the current preset cleaning region is greater than or equal to the second dirt amount threshold and less than the first dirt amount threshold, it indicates that the preset cleaning region is not very dirty. Then the remaining preset cleaning regions are cleaned first to allow the floor corresponding to the cleaning task map being cleaned at least once as soon as possible, thereby making the floor look less dirty overall.

Illustratively, the controlling the cleaning robot to mop at least part of the target region through the mopping member further includes: obtaining a second dirtiness degree corresponding to the target region; determining that the target region needs to be mopped again repeatedly according to the second dirtiness degree corresponding to the target region; and mopping at least part of the target region again repeatedly. It should be understood that, the second dirtiness degree corresponding to the target region is configured to determine whether the target region needs to be repeatedly mopped, and if so, at least part of the target region will be mopped repeatedly.

It should be noted that, the first dirtiness degree and the second dirtiness degree may be configured to indicate the dirtiness degree of a same region. Alternatively, the first dirtiness degree is configured to indicate the dirtiness degree of one region, and the second dirtiness degree is configured to indicate the dirtiness degree of at least part of this region. Illustratively, the first dirtiness degree may be the dirtiness degree of the preset cleaning region as determined by the mopping member dirtiness degree when the preset cleaning region is mopped for the first time in the current cleaning task; the second dirtiness degree is the dirtiness degree as determined by the mopping member dirtiness degree when at least part of the preset cleaning region, such as the target region is again repeatedly mopped, or when at least part of the target region is again repeatedly mopped.

Illustratively, when the first dirtiness degree is greater than or equal to the preset first dirt amount threshold, the cleaning robot is immediately controlled to mop at least part of the target region through the mopping member, and a second dirtiness degree corresponding to the target region is obtained. For example, after mopping at least part of the target region through the mopping member, a detection value of the sewage generated by cleaning the mopping member is obtained. The mopping member dirtiness degree of the mopping member is determined according to the obtained detection value, and the second dirtiness degree corresponding to the target region is determined based on the mopping member dirtiness degree of the mopping member. The present disclosure is certainly not limited thereto. For example, the mopping member dirtiness degree of the mopping member and the second dirtiness degree corresponding to the target region may be determined according to an image or color information of the mopping member, or the second dirtiness degree corresponding to the target region may be obtained by at least one of a vision sensor, an infrared sensor, and the like.

Illustratively, after determining that the target region needs to be again repeatedly mopped according to the second dirtiness degree corresponding to the target region, at least part of the target region is again repeatedly mopped. After again repeatedly mopping the target region, the method further includes: ending again repeatedly mopping the target region when the number of times the target region is again repeatedly mopped meets a cleaning times threshold. For example, when the second dirtiness degree corresponding to the target region is greater than or equal to the preset dirt amount threshold, such as the first dirt amount threshold or the second dirt amount threshold, at least part of the target region is again repeatedly mopped. After again repeatedly mopping the target region, the second dirtiness degree corresponding to the target region may be obtained again, and the second dirtiness degree is configured to determine whether the target region needs to be repeatedly mopped again. When the number of times for again repeatedly mopping the target region meets the cleaning times threshold, such as 3, again repeated mopping of the target region is terminated. It should be understood that if the second dirtiness degree of the target region after multiple times of again repeated mopping still fails to fall below the dirt amount threshold, cleaning of that target region is also stopped if the cleaning times reaches an upper limit of the cleaning times, namely the cleaning times threshold. This can prevent repeated mopping of a preset cleaning region that is relatively dirt again and again, thereby reducing the effect on the cleaning of other preset regions.

In some embodiments, when the number of times of again repeated mopping the target region meets a cleaning times threshold, the again repeated mopping of the target region is terminated, and a message may be sent to a user interface to prompt the user that the target region is relatively dirty. In this way, the user can go to the target region to check whether there is a continuous dirt leakage and deal with it in time.

In some embodiments, the cleaning times threshold may be determined according to the cleaning mode. Different cleaning modes correspond to different cleaning times thresholds. For example, the cleaning times threshold for the deep cleaning mode is greater than the cleaning times threshold for the normal cleaning mode or the fast cleaning mode.

Illustratively, when the first dirtiness degree is greater than or equal to the preset first dirt amount threshold, the cleaning robot is immediately controlled to mop the target region through the mopping member, and a second dirtiness degree corresponding to the target region is obtained. When the second dirtiness degree is greater than the second dirt amount threshold, it is determined that the target region needs to be again repeatedly mopped, then the cleaning robot is controlled to continue mopping the target region again until the second dirtiness degree corresponding to the target region is less than the second dirt amount threshold, and the other preset cleaning regions will be mopped after mopping of at least part of the target region has been completed and the mopping member has been maintained. For example, after determining that the target region needs to be again repeatedly mopped, the cleaning robot is controlled to continue mopping the target region again, and a second dirtiness degree corresponding to the target region is obtained after again repeatedly mopping the target region. When the second dirtiness degree is greater than the second dirt amount threshold, after maintenance of the mopping member, the cleaning robot is controlled to continue to mop the target region again until the second dirtiness degree corresponding to the target region is less than the second dirt amount threshold. Then the mopping of the target region is ended, and other preset cleaning regions are cleaned. When the cleaning robot passes through other preset cleaning regions after mopping the target region, the dirt adhering to the mopping member may contaminate these preset cleaning regions. However, the contamination can be removed by subsequent cleaning of the other preset cleaning regions after finishing mopping the target region.

Illustratively, when the first dirtiness degree is greater than or equal to the preset first dirt amount threshold, the cleaning robot is immediately controlled to mop the target region through the mopping member, and a second dirtiness degree corresponding to the target region is obtained. When the second dirtiness degree is greater than the first dirt amount threshold, the cleaning robot is controlled to continue mopping the target region again until the second dirtiness degree is greater than or equal to the preset second dirt amount threshold and less than the first dirt amount threshold. After mopping of all the preset cleaning regions has been completed and the mopping member is maintained, the cleaning robot is controlled to mop at least part of the target region through the mopping member. For example, after the target region is repeatedly mopped until the second dirtiness degree is less than the first dirt amount threshold, the other preset cleaning regions are mopped. When the second dirtiness degree of the target region is less than the first dirt amount threshold and greater than or equal to the preset second dirt amount threshold, the target region may be marked as a region that needs repeated mopping after mopping of all the preset cleaning regions has been completed. Then after mopping of all the preset cleaning regions has been completed and the mopping member is maintained, the cleaning robot is controlled to mop at least part of the target region through the mopping member to further clean the preset cleaning region. By mopping the very dirty region first until it is not very dirty, and then mopping the other regions, all regions can be cleaned more quickly and the contamination of the mopped floor brought by the mopping member can be reduced. After the cleaning of all the regions has been finished, the floor that is not very dirty is repeatedly mopped to improve the cleanliness of that region.

In some embodiments, when the first dirtiness degree of the current preset cleaning region is greater than or equal to the preset second dirt amount threshold and less than the first dirt amount threshold, the preset cleaning region is determined to include a target region, then the cleaning robot is controlled to mop at least part of the target region through the mopping member after mopping of all the preset cleaning regions has been completed and the mopping member is maintained. After mopping of all the preset cleaning regions has been completed, one or more of the preset cleaning regions may be determined to include the target regions. Referring to FIG. 10, the preset cleaning regions A1, A2, A4, and A7 include the target regions. Illustratively, the method further includes: after mopping of all the preset cleaning regions has been completed, determining a mopping order of a plurality of the target regions according to characteristic parameters of the plurality of the target regions. The characteristic parameter of each target region includes at least the following: the dirtiness degree corresponding to the target region, a distance between the target region and the cleaning robot, and a room identifier of the room where the target region is located. When the cleaning robot is controlled to mop at least part of the target regions through the mopping member, the cleaning robot may be controlled to mop the at least part of the plurality of target regions according to the mopping order. The cleaning of the regions that need to be repeatedly mopped according to the mopping order improves the cleaning effect and/or cleaning efficiency of the repeated mopping.

Illustratively, the cleaning robot is controlled to mop the at least part of the plurality of target regions in an order of the dirtiness degrees from largest to smallest. For example, repeated mopping of the target region of larger dirtiness degree is followed by repeated mopping of the target region of smaller dirtiness degree. As such, even if the dirt adhering to the mopping member contaminates the target regions of smaller dirtiness degree as the cleaning robot passes through these target regions of smaller dirtiness degree, it is possible to clean these target regions of smaller dirtiness degree while subsequently cleaning these target regions.

Illustratively, the cleaning robot is controlled to mop the at least part of the plurality of target regions in an order of the dirtiness degrees from smallest to largest. For example, after repeated mopping of the target region of smaller dirtiness degree, the mopping member still has the capability to pick up dirt, and when the cleaning robot passes through the target region of larger dirtiness degree, it can pick up at least part of the dirt in this target region, and then return to the base station for maintenance. Later mopping of the target region of larger dirtiness degree can improve the cleaning effect of the target region.

Illustratively, the cleaning robot is controlled to mop the at least part of the plurality of target regions in order of the distance between each of the target regions and the cleaning robot from nearest to farthest. For example, the nearer target region is mopped first, which reduces the walking distance of the cleaning robot and improves the cleaning efficiency.

Illustratively, the cleaning robot is controlled to mop the at least part of the plurality of target regions in order of the distance between each of the target regions and the cleaning robot from farthest to nearest. For example, the farther target region is repeatedly mopped first and then the nearer target region is repeatedly mopped. As such, when cleaning the nearer target region, it is possible to clean off the contamination introduced by the dirt adhering to the mopping member during cleaning the farther target region. For example, after repeated mopping of the farther target region, when the cleaning robot returns to the base station through the nearer target region, the mopping member can pick up at least part of the dirt of the nearer target region and then return to the base station for maintenance, which will improve the cleaning effect of the nearer target region when the nearer target region is subsequently mopped.

Illustratively, the mopping member may repeatedly mop a kitchen first, and then a living room and a bedroom. The present disclosure is certainly not limited thereto. For example, the mopping member may mop these regions in a reverse order.

In some embodiments, the step of after mopping of all the preset cleaning regions has been completed, determining the mopping order of the plurality of target regions according to the dirtiness degrees corresponding to the target regions includes: determining the target regions that have dirtiness degrees differences therebetween less than or equal to a difference threshold as a merged region; and determining the dirtiness degree of the merged region based on the dirtiness degrees of the target regions within the same merged region.

Illustratively, after mopping of all the preset cleaning regions has been completed, that is, after each preset cleaning region is mopped at least once, one or more of the preset cleaning regions may be determined as the target regions that still need to be repeatedly mopped. For example, when a dirtiness degree difference among the plurality of target regions is less than or equal to the difference threshold, and a sum of the dirtiness degrees of the plurality of target regions is less than or equal to the first dirt amount threshold or the second dirt amount threshold, the plurality of target regions are determined to be the merged region. Referring to FIG. 10, the preset cleaning regions A1, A2, A4 and A7 are the target regions. The target region A1 is mopped once, and the dirtiness degree corresponding to the target region A1, namely the first dirtiness degree of the preset cleaning region A1, is 20; the target region A2 is mopped twice, and after the latest mopping, the second dirtiness degree of the target region A2 is determined to be 25 according to the mopping member dirtiness degree; then the target region A1 and the target region A2 are determined to be the merged region.

Typically, the dirtiness degree of the merged region may be determined according to the maximum value, the minimum value, a sum, or an average value of the dirtiness degrees corresponding to the target regions within the merged region.

In some embodiments, the controlling the cleaning robot to mop the target regions through the mopping member includes: when the dirtiness degree of the merged region is less than or equal to a preset merge dirt threshold, controlling the cleaning robot to mop the target regions within the merged region through the mopping member. For example, the merge dirt threshold is determined according to the maximum dirt value d_max of the mopping member. For example, the merge dirt threshold may be the first dirt amount threshold or the second dirt amount threshold. By repeatedly mopping the merged region of multiple target regions, the re-mopped area is increased, such that the time for the cleaning robot to travel to and from the base station is reduced, thereby improving the cleaning efficiency. In addition, the cleaning effect of each target region in the merged region can still be guaranteed when the sum of the dirtiness degrees corresponding to each target region in the merged region is less than or equal to the maximum dirt value d_max of the mopping member.

Illustratively, a mopping order of a plurality of merged regions may be determined according to the dirtiness degrees of the merged regions. Or, when there are one or more unmerged target regions, the mopping order of the one or more merged regions and the one or more unmerged target regions may be determined according to the dirtiness degrees of the one or more merged regions and the one or more unmerged target regions. The cleaning effect and/or cleaning efficiency of repeated mopping can be improved by cleaning the to be re-mopped regions according to the mopping order. For example, the mopping order of the one or more merged regions and the one or more unmerged target regions is determined according to the characteristic parameters of the one or more merged regions and the one or more unmerged target regions, with specific reference to the foregoing step of determining the mopping order of the plurality of target regions based on the characteristic parameters of the target regions.

Figure 11:
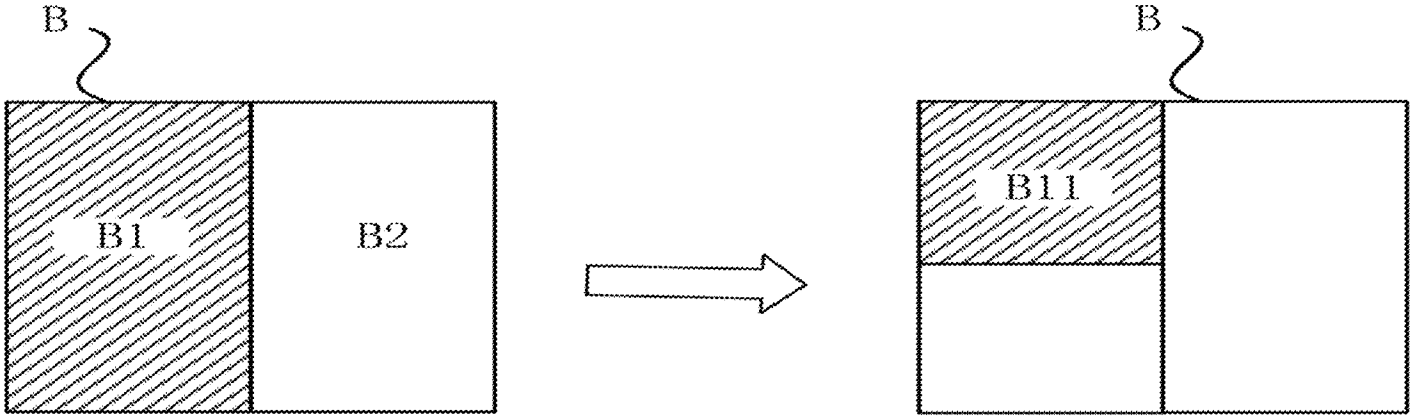
FIG. 11 is a schematic diagram showing repeatedly mopping to a target region according to an embodiment of the present disclosure.

In some embodiments, referring to FIG. 11, the step of controlling the cleaning robot to mop at least part of the target region B through the mopping member includes: dividing the target region B into a plurality of sub-target regions (for example, sub-target regions B1 and B2), and controlling the cleaning robot to mop at least one of the sub-target regions (such as B1) through the mopping member. For example, when repeatedly mopping the target region, part of the sub-target regions is mopped first, and the remaining part (such as B2) of the sub-target regions is cleaned after the mopping member is maintained. Alternatively, when repeatedly mopping the target region, only the sub-target region that is relatively dirty (such as B1) is mopped.

Illustratively, the step of controlling the cleaning robot to mop at least one of the sub-target regions through the mopping member includes: controlling the cleaning robot to mop the sub-target regions (B1 and B2) in sequence through the mopping member; obtaining a third dirtiness degree of the sub-target region (such as B1), and determining whether the sub-target region (B1) needs to be repeatedly mopped; and if yes, continuing to divide the sub-target region (B1) and mopping the divided regions (such as B11 and B12). It should be understood that, whether the sub-target region needs to be repeatedly mopped is determined according to the third dirtiness degree of the sub-target region; and if yes, the sub-target region is further divided and the divided regions are then mopped. For example, the target region may be divided into a plurality of sub-target regions, after the sub-target regions are mopped, the third dirtiness degrees of the sub-target regions are determined according to the dirtiness degree of the mopping member, then the sub-target region in the target region that is relatively dirty can be determined. The sub-target region may be further divided to determine the dirtiness degree of a smaller region, so as to repeatedly mop the smaller region. It should be understood that, by dividing the region to be repeatedly mopped and gradually reducing the region to be repeatedly mopped, the cleaning efficiency and the cleaning effect of repeated mopping is improved.

Illustratively, referring to FIG. 11, the step of controlling the cleaning robot to mop at least one of the sub-target regions through the mopping member includes: controlling the cleaning robot to mop one of the sub-target regions, such as B 1, through the mopping member; estimating a second dirtiness degree of the target region B and acquiring a third dirtiness degree of the sub-target region B1, and determining whether the repeated mopping of the target region is not finished according to the second dirtiness degree and the third dirtiness degree; if not (the repeated mopping is finished), repeatedly mopping the next sub-target region. For example, when the third dirtiness degree of the sub-target region B1 is close to or equal to the second dirtiness degree of the target region B, it can be determined that the dirt of the target region B is mainly concentrated in the sub-target region B1, while the sub-target region B2 is relatively clean and can be mopped without repetition. That is, it is determined that the repeated mopping of the target region is finished. When the third dirtiness degree of the sub-target region B1 is much smaller than the second dirtiness degree of the target region B, such as less than half, it can be determined that some other sub-target region, such as B2, is still relatively dirty and needs to be repeatedly mopped. That is, it is determined that the repeated mopping of the target region is not finished.

Referring to FIG. 11, when the sub-target region B1 is repeatedly mopped, the sub-target region B1 is divided into the smaller regions B11 and B12. The cleaning robot is controlled to mop the region B11, and the dirtiness degree of the region B11 is determined. According to the dirtiness degree of the region B11 and the third dirtiness degree of the sub-target region B 1, whether the regions B11 and B12 need to be repeatedly mopped is determined. By dividing the region to be repeatedly mopped and determining whether a smaller region needs to be repeatedly mopped according to the dirtiness degrees of the divided smaller regions, the region to be repeatedly mopped can be gradually reduced, thereby improving the cleaning efficiency.

In some embodiments, the cleaning method for the mopping member further includes: determining whether the mopping member is used to mop the floor within a preset period of time, if not, then performing and ending the mopping member cleaning task according to a post-task cleaning threshold. The post-task cleaning threshold is less than or equal to the cleaning threshold determined according to the value range where the mopping member dirtiness degree is located. In some embodiments, the post-task cleaning threshold is less than the first cleaning threshold and the second cleaning threshold; or, the post-task cleaning threshold is equal to the smallest one of the cleaning thresholds determined by the value range.

When the mopping member will not be used to mop the floor for a long period of time, such as one day, or the current cleaning task has been finished (for example, each preset cleaning region in the cleaning task map does not include a target region, a sub-target region, or a smaller dirty region), and the next cleaning task will be performed after a preset length of time, the mopping member can be cleaned until the dirt elution value is less than or equal to the post-task cleaning threshold. This allows the mopping member to be cleaned more thoroughly, thereby preventing odors from being generated within the preset length of time.

In some embodiments, the mopping member dirtiness degree is determined according to the detection value of the sewage generated by cleaning the mopping member and a zero-bias value of the mopping member. For example, the dirt elution value in each stage task is determined according to the detection value of the sewage in each stage task and the zero-bias value. For example, the zero-bias value is the detection value detected by the sewage detection sensor when detecting clean water or near clean water sewage. The difference between the sewage detection value and the zero-bias value provides a more accurate indication of the dirt amount generated by the mopping member cleaning the floor and the amount of elution when cleaning the mopping member, thereby eliminating the deviation caused by the error of the sewage detection sensor and/or the aging of the mopping member.

For example, during the cleaning of the mopping member, when the detection value of the sewage detection sensor reaches a stable value, such as in a period of time no longer change, or the slope of the change is basically 0, then the stable value is determined to be the zero-bias value.

Illustratively, the zero-bias value includes a first zero-bias value that is pre-stored and factory-set, and/or a second zero-bias value updated according to the detection value of the sewage detection sensor. For example, in case of an unused mopping member, or where the second zero-bias value has not been determined for the mopping member or where the second zero-bias value is missing, the mopping member dirtiness degree of the mopping member may be determined based on the factory-set first zero-bias value. When the second zero-bias value is stored, the second zero-bias value is used in preference. For example, when a mopping member that has not yet been used is cleaned for the first time, the second zero-bias value is determined according to the first zero-bias value and the detection value of the sewage generated by cleaning the mopping member, the mopping member dirtiness degree of the mopping member can then be determined according to the second zero-bias value and the detection value. In addition, the second zero-bias value may be calibrated according to the detection value.

In some embodiments, the method further includes: obtaining the detection value of the sewage generated by cleaning the mopping member after ending the mopping member cleaning task and/or before mopping the floor through the mopping member; and calibrating the zero-bias value according to the detection value when an absolute value of a difference between the detection value and the zero-bias value is less than or equal to a first difference threshold.

For example, when performing the mopping member cleaning task, after finishing the preset cleaning task, the mopping member cleaning task is ended according to the post-task cleaning threshold. Then, it is determined whether an absolute value of a difference between the detection value of the sewage generated by cleaning the mopping member and the first zero-bias value/the second zero-bias value is less than or equal to the first difference threshold value, when it is determined that the mopping member cleaning task is ended or after the mopping member cleaning task is ended. When the absolute value of the difference is less than or equal to the first difference threshold value, the second zero-bias value is updated to the detection value. This can eliminate a detection value deviation caused by the error of the sewage detection sensor and/or the aging of the mopping member, when the detection value of the sewage is determined according to the first zero-bias value/the second zero-bias value.

In some embodiments, the method further includes: continuing to perform the next stage task when an absolute value of a difference between the detection value in the one or more performed stage tasks of the mopping member cleaning task and the zero-bias value is greater than the first difference threshold; and calibrating the zero-bias value according to the detection value of the next stage task, when an absolute value of a difference between the detection value of the next stage task and the zero-bias value is less than or equal to the second difference threshold, and an absolute value of a difference between the detection value of the next stage task and the detection value of the latest performed stage task is less than or equal to the third difference threshold. For example, the cleaning of the mopping member can be continued when the absolute value of the difference between the detection value and the zero-bias value is greater than the first difference threshold; and the second zero-bias value is updated to the latest detection value, when the mopping member dirtiness degree is stable (the absolute value of the difference between the detection values of two adjacent stage tasks is less than or equal to the third difference threshold), and the absolute value of the difference between the latest detection value and the zero-bias value is less than or equal to the second difference threshold. In some embodiments, the second difference threshold is greater than or equal to the first difference threshold, so that the second zero-bias value can be updated according to the detection value when the mopping member is aged.

In some embodiments, the method further includes: when the absolute value of the difference between the detection values of two adjacent stage tasks of the mopping member cleaning task is greater than the third difference threshold, continuing to perform the next stage task until the absolute value of the difference between the detection values of the two adjacent stage tasks is less than or equal to the third difference threshold. When the mopping member dirtiness degree is unstable, it cannot be determined that the mopping member has been cleaned as clean as it can be. Then continue to clean the mopping member until the mopping member dirtiness degree is stable. In this case, it can be determined that the mopping member has been cleaned as clean as it can be, and the second zero-bias value is updated according to the stable detection value.

In some embodiments, the method further includes: when the absolute value of the difference between the detection value of the latter stage task of the two adjacent stage tasks and the zero-bias value is greater than the second difference threshold, continuing to perform the next stage task until the absolute value of the difference between the detection value of the latter stage task of the two adjacent stage tasks and the zero-bias value is less than or equal to the second difference threshold. When the absolute value of the difference between the detection value and the zero-bias value is greater than the second difference threshold, it cannot be determined that the mopping element has been cleaned as clean as it can be, and then continue to clean the mopping member; until the absolute value of the difference between the latest detection value and the zero-bias value is less than or equal to the second difference threshold, the second zero-bias value may be updated to the latest detection value.

In some embodiments, the method further includes: when a quantity of the stage tasks reaches a stage quantity threshold, outputting prompt information, wherein the prompt information is configured to indicate malfunction of the sensor for detecting the sewage. For example, when the quantity of the stage tasks reaches the stage quantity threshold, the absolute value of the difference between the detection value in each stage task and the first zero-bias value/the second zero-bias value is greater than the first difference threshold or the second difference threshold, and the absolute value of the difference between the detection values of two adjacent stage tasks is greater than the third difference threshold, then the mopping member cleaning task can be stopped, and it is determined that the sensor for detecting the sewage malfunctions. The prompt information may be further configured to prompt a user to replace the mopping member.

In some embodiments, the method further includes: outputting prompt information after a sum of the time/the amount of water consumed in the stage tasks reaches a corresponding threshold. The prompt information is configured to indicate that the sensor for detecting the sewage malfunctions.

In some embodiments, after the determining that the preset cleaning region includes the target region, the method further includes: sending a message to a user interface on a base station or on a user terminal, so as to allow the user to choose to mop the target region. In response to a determination of mopping the target region, the cleaning robot is controlled to mop at least part of the target region through the mopping member after mopping of the preset cleaning region has been completed and the mopping member is maintained. It should be understood that the message is sent to the user interface for a user to choose whether to mop the target region, and if yes, the cleaning robot is controlled to mop at least part of the target region through the mopping member after mopping of the preset cleaning region has been completed and the mopping member is maintained. The user is allowed to autonomously choose whether to repeatedly mop the target region. For example, when the user is ready for bed, he/she may choose not to mop the target region.

In some embodiments, the cleaning system further includes a handheld cleaning device. Or, the cleaning system includes a plurality of cleaning robots, such as a first cleaning robot and a second cleaning robot.

In some embodiments, the control apparatus or the first cleaning robot is capable of transmitting information of the target region to the handheld cleaning device or the second cleaning robot.

Illustratively, the information of the target region may be transmitted to the handheld cleaning device. Or, when it is determined that the region needs to be repeatedly mopped according to the mopping member dirtiness degree after the first cleaning robot has cleaned that region, the information of the target region is transmitted to the handheld cleaning device and/or the second cleaning robot, so as to allow the cleaning device other than the first cleaning robot to repeatedly mop this region. In some embodiments, the first cleaning robot may continue to mop other regions, thereby improving cleaning efficiency and cleaning effect through multi-device collaboration.

The controlling method for the cleaning robot provided by the embodiments of the present disclosure includes: controlling the cleaning robot to mop a preset cleaning region through a mopping member; obtaining a first dirtiness degree corresponding to the preset cleaning region; determining that the preset cleaning region includes a target region according to the first dirtiness degree, wherein the target region is the region that needs to be mopped repeatedly; after mopping of the preset cleaning region and maintenance of the mopping member have been completed, controlling the cleaning robot to mop at least part of the target region through the mopping member. According to the dirtiness degree of the preset cleaning region, whether at least part of the preset cleaning region needs to be repeatedly mopped is determined, and if yes, the mopping member, after being maintained, repeatedly mops the at least part of the preset cleaning region, thereby improving the cleaning effect of the preset cleaning region.

In some embodiments, the dirtiness degree of the floor mopped by the cleaning robot may be determined by dirtiness degree detection of the mopping member. For example, whether the floor mopped by the cleaning robot is clean may be determined according to whether the mopping member dirtiness degree reaches a limit value of the dirt adhering capacity of the mopping member.

In some embodiments, different cleaning modes are set with different dirt thresholds. Whether the cleaning of the floor which has been mopped by the cleaning robot is continued or terminated is determined according to the comparison between the mopping member dirtiness degree and the dirt threshold. In some embodiments, the maximum number of cleaning times is set so that cleaning can be terminated when the maximum number of cleaning times is reached, even if the mopping member dirtiness degree is not reduced to below the dirt threshold.

The cleaning method for the mopping member provided by the embodiments of the present disclosure includes: performing a mopping member cleaning task; obtaining a mopping member dirtiness degree of the mopping member; determining a cleaning threshold according to a value range where the mopping member dirtiness degree is located, and ending the mopping member cleaning task according to the cleaning threshold. The working efficiency of the cleaning robot is improved by automatically adjusting the cleanliness level of the mopping member. The mopping member dirtiness degree can reflect the dirtiness degree of the floor. For example, the dirtiness degree of the region that has been mopped can be determined according to the mopping member dirtiness degree of the mopping member, and the cleaning threshold can be determined according to the value range where the mopping member dirtiness degree is located. It is possible to adjust the cleanliness level of the mopping member according to the dirtiness degree of the floor to improve the working efficiency of the cleaning robot.

In some embodiments, after the cleaning robot cleans the preset cleaning region, the cleaning member is cleaned, and the dirt elution value of the mopping member is detected when the cleaning duration meets the preset duration (for example, a stage task duration). When the dirt elution value is greater than the cleaning threshold, a next stage task is continued to clean the mopping member; and when the dirt elution value in a certain stage task is less than or equal to the cleaning threshold of the stage task, the mopping member cleaning task is stopped. The cleaning threshold of each stage task may be preset, or the cleaning threshold of at least one stage task is determined according to the dirt elution value in the one or more performed stage task. According to the dirt elution value of the mopping member, a region dirtiness degree of the mopped region can be determined, such as the first dirtiness degree of the preset cleaning region. When the region dirtiness degree of the mopped region is greater than the first dirt amount threshold, the cleaning robot immediately returns to the mopped region to repeatedly mop that region after the mopping member cleaning task is ended. When the region dirtiness degree of the mopped region is less than the first dirt amount threshold and greater than or equal to the second dirt amount threshold, the mopped region is marked as the target region, namely the region that needs to be repeatedly mopped. When there is a region in the cleaning task map that has not been mopped, then that region that has not been mopped is mopped; after all the preset cleaning regions in the cleaning task map are mopped at least once, the mopped region marked as the target region is mopped repeatedly. When there is no region in the cleaning task map that needs to be mopped repeatedly, it is determined that the cleaning task is finished, and the mopping member can be cleaned to be cleaner according to the post-task cleaning threshold, so as to be long-term stored.

In some other embodiments, when the dirtiness degree of the mopped region is greater than the first dirt amount threshold, the cleaning robot immediately returns to the mopped region to repeatedly mop after the mopping member cleaning task is ended. When cleaning the mopping member after repeatedly mopping the mopped region, continue to determine whether the dirt elution value is less than or equal to the cleaning threshold, and if not, determine that the mopped region is still not clean, and the mopping member cleaning task can be stopped and repeatedly mopping the mopped region is continued until the mopped region is clean, namely, the dirt elution value is less than or equal to the cleaning threshold. After that, when there is still a region in the cleaning task map that has not been mopped, the region that has not been mopped may be mopped.

Figure 12:
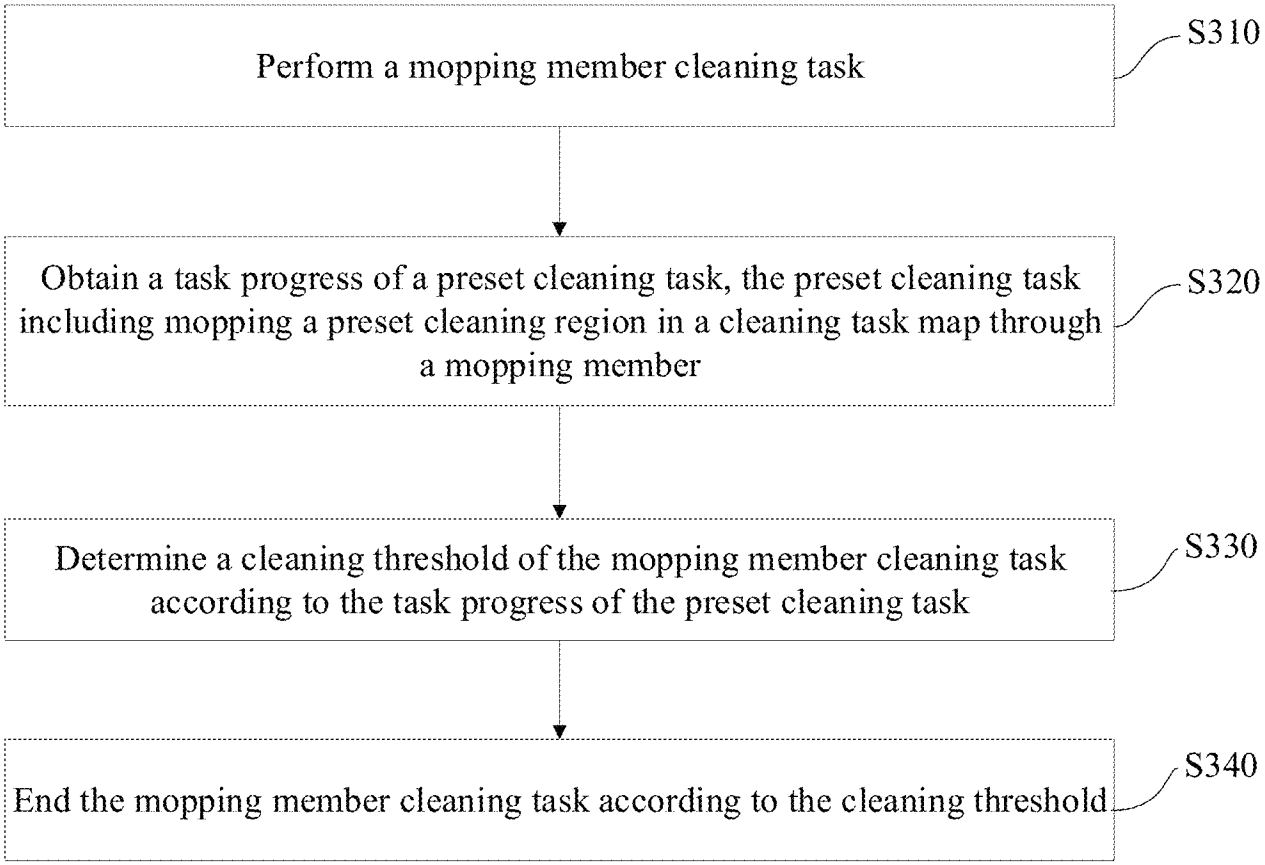
FIG. 12 is a schematic flowchart of a cleaning method for a mopping member according to another embodiment of the present disclosure.

In combination with the foregoing embodiments and referring to FIG. 12, FIG. 12 is a schematic flowchart of a cleaning method for a mopping member according to an embodiment of the present disclosure. A cleaning threshold of a mopping member cleaning task is determined according to a task progress of a preset cleaning task, which allows the cleanliness level of the mopping member that has been cleaned according to the cleaning threshold to correspond to a current task progress, thereby improving the working efficiency of the cleaning robot.

As shown in FIG. 12, the cleaning method for the mopping member includes step S310 to step S340.

Step S310, perform a mopping member cleaning task.

Illustratively, the mopping member has a limited capability to collect dirt. When the dirt amount collected by the mopping member, namely the mopping member dirtiness degree d reaches the maximum dirt value d_max of the mopping member, the mopping member will no longer become dirtier by mopping, and the mopping cleaning effect to the floor will be poor. In this case, the mopping needs to be stopped. The mopping member is cleaned by controlling cleaning mechanism to perform the mopping member cleaning task of the mopping member, after cleaning to a certain degree, the mopping member has the capability to adhere dirt.

Step S320, obtain a task progress of a preset cleaning task, the preset cleaning task including mopping a preset cleaning region in a cleaning task map through a mopping member.

In some embodiments, the preset cleaning region may be determined according to a room in the cleaning task map, and/or a workload threshold of the cleaning robot. Illustratively, the workload of each preset cleaning region is less than or equal to the workload threshold. Illustratively, one room is one preset cleaning region, or one room includes a plurality of preset cleaning regions. The present disclosure is certainly not limited thereto. For example, one preset cleaning region may include one room and at least part of another room. In some embodiments, the preset cleaning region may be determined by user's division operations on the cleaning task map, or may be determined by division according to preset region division rules.

The preset cleaning task includes mopping one or more preset cleaning regions in the cleaning task map, for example, mopping all the preset cleaning regions in the cleaning task map. In some embodiments, a mopping member cleaning operation performed between two floor cleaning operations may be treated as one mopping member cleaning task. The mopping member cleaning task for cleaning the mopping member may include, for example, the process of cleaning the mopping member after cleaning one preset cleaning region and before cleaning another preset cleaning region, and may also include the process of cleaning the mopping member after finishing the cleaning task of the cleaning task map. For example, when the dirtiness degrees of all the regions in the cleaning task map are less than the corresponding dirt amount threshold, the preset cleaning task is ended, and then the mopping member cleaning task is performed.

In some embodiments, when performing the preset cleaning task, the mopping member is cleaned by the cleaning mechanism of the cleaning robot. After performing the preset cleaning task, the cleaning robot is controlled to return to the base station, and the mopping member is cleaned by the cleaning mechanism of the base station. It should be understood that the mopping member cleaning task includes one or more sub-mopping member cleaning tasks of cleaning the mopping member which is performed by the cleaning mechanism of the cleaning robot during performing the preset cleaning task, and also includes one or more sub-mopping member cleaning tasks of cleaning the mopping member which is performed by the cleaning mechanism of the base station after performing the preset cleaning task.

In some embodiments, the task progress of the cleaning task includes whether the preset cleaning task has been finished. When there is a region in the cleaning task map that is relatively dirty (for example, the dirtiness degree of that region is greater than or equal to the corresponding dirt amount threshold), it can be determined that at least part of that region in the cleaning task map needs to be mopped within a preset duration after finishing the mopping member cleaning task, that is, the preset cleaning task has not been finished. When all the regions in the cleaning task map are relatively clean (for example, the dirtiness degree of each region is less than the corresponding dirt amount threshold), it can be determined that there is no need to mop the floor within the preset duration after finishing the mopping member cleaning task, that is, the preset cleaning task has been finished.

Step S330, determine a cleaning threshold of the mopping member cleaning task according to the task progress of the preset cleaning task.

Step S340, end the mopping member cleaning task according to the cleaning threshold.

By determining the cleaning threshold of the mopping member cleaning task according to the task progress, it allows the cleanliness level of the mopping member that has been cleaned according to the cleaning threshold to correspond to the current task progress, thereby improving the working efficiency of the cleaning robot.

In some embodiments, the determining the cleaning threshold of the mopping member cleaning task according to the task progress of the preset cleaning task includes: determining the cleaning threshold to be an in-task cleaning threshold when the task progress of the preset cleaning task is that the preset cleaning task has not been finished; and determining the cleaning threshold to be a post-task cleaning threshold when the task progress of the preset cleaning task is that the preset cleaning task has been finished. The post-task cleaning threshold is less than the in-task cleaning threshold.

When the mopping member will not be used to mop the floor for a long period of time, such as one day, or the current cleaning task has been finished (for example, each preset cleaning region in the cleaning task map does not include a target region that is relatively dirty), and the next cleaning task will be performed after a preset length of time, then the cleaning threshold of the mopping member cleaning task is determined to be the smaller post-task cleaning threshold. This allows the mopping member to be cleaned more thoroughly when ending the mopping member cleaning task according to the post-task cleaning threshold, thereby preventing odors from being generated within the preset length of time.

In some embodiments, the task progress of the preset cleaning task further includes a sub-cleaning task after the mopping member cleaning task has been finished, namely a next sub-cleaning task. The next sub-cleaning task is, for example, to mop a preset cleaning region that has been mopped, or to mop a preset cleaning region in the cleaning task map that has not been mopped. The preset cleaning region that has been mopped may be referred to as the target region. The target region is the preset cleaning region that needs to be repeatedly mopped, so as to increase the cleanliness level of the target region. For example, the target region may be a relatively dirty region, and/or a region with a relatively high cleaning requirement.

Illustratively, a first dirtiness degree corresponding to each preset cleaning region in the cleaning task map may be obtained. According to the first dirtiness degree, the preset cleaning region is determined to include the target region, wherein the target region is the region that needs to be repeatedly mopped. After mopping of the preset cleaning region and cleaning of the mopping member have been completed, the cleaning robot is controlled to mop at least part of the target region through the mopping member.

Illustratively, when the cleaning robot moves in the preset cleaning region, for example, when the cleaning robot mops the preset cleaning region, the cleaning robot acquires the first dirtiness degree corresponding to the preset cleaning region by at least one of a vision sensor and an infrared sensor arranged on the cleaning robot. It should be understood that, the corresponding first dirtiness degree may be acquired before or during the mopping of the preset cleaning region. The present disclosure is certainly not limited thereto. For example, the first dirtiness degree corresponding to the preset cleaning region may be acquired by a sensor that is not disposed on the cleaning robot, such as a vision sensor arranged on a roof.

In some embodiments, the acquiring the first dirtiness degree corresponding to the preset cleaning region includes: obtaining the mopping member dirtiness degree of the mopping member after the cleaning robot has completed mopping of the preset cleaning region through the mopping member; and determining the first dirtiness degree corresponding to the preset cleaning region according to the mopping member dirtiness degree.

Illustratively, the mopping member dirtiness degree is obtained by the dirt detection apparatus, such as a vision sensor disposed on the base station. For example, the darker the mopping member 110, the greater the mopping member dirtiness degree. The present disclosure is certainly not limited thereto. For example, the mopping member dirtiness degree may be obtained by a vision sensor arranged on the cleaning robot and facing the mopping surface of the mopping member.

Illustratively, the obtaining the mopping member dirtiness degree of the mopping member includes: obtaining, when cleaning the mopping member, a detection value of sewage generated by cleaning the mopping member; and determining the mopping member dirtiness degree according to the detection value. In some embodiments, the dirt detection apparatus includes a sewage detection sensor, which is configured to detect, for example, one or more of turbidity, chroma, and water conductivity of the sewage by cleaning the mopping member. The dirt amount cleaned from the mopping member may be determined according to the turbidity, the chroma, or the water conductivity of the sewage. For example, the larger the turbidity, the chroma or the water conductivity of the sewage, the dirtier the sewage by cleaning the mopping member, and the greater the dirt amount cleaned from the mopping member, that is, the greater the dirt elution value for characterizing the dirt amount cleaned from the mopping member, the greater the dirt amount adhering to the mopping member before the cleaning of the mopping member, that is, the larger the mopping member dirtiness degree. It should be understood that, each of the turbidity, the chroma, and the water conductivity of the sewage may be configured to characterize the dirt amount cleaned from the mopping member, namely the mopping member dirtiness degree. Each of the turbidity, the chroma, and the water conductivity of the sewage has positive correlation or corresponding relationship with the dirt elution value, the dirt amount, or the mopping member dirtiness degree. For example, the turbidity of the sewage generated by the first cleaning of the mopping member is 1NTU, and the corresponding dirt elution value or the dirt amount is 100; the turbidity of the sewage generated by the second cleaning of the mopping member is 2NTU, and the corresponding dirt elution value or the dirt amount is 200. In this case, it can be determined that the dirt amount cleaned from the mopping member for the first time is less than the dirt amount cleaned from the mopping member for the second time. That is, the dirt elution value of the first cleaning is less than the dirt elution value of the second cleaning. The corresponding relationship between the chroma or the water conductivity of the sewage and the dirt elution value or the dirt amount is similar, which is not detailed herein. It should be understood that the mopping member dirtiness degree may be characterized by a numerical value, such as any one of the turbidity of the sewage, the chroma of the sewage, the water conductivity of the sewage, the dirt amount, and the dirt elution value; or, the mopping member dirtiness degree may be determined by any one of the turbidity of the sewage, the chroma of the sewage, the water conductivity of the sewage, the dirt amount, and the dirt elution value. For example, if the turbidity of the sewage by cleaning the mopping member is 1NTU, the mopping member dirtiness degree of the mopping member may be characterized by 1; or if the turbidity of the sewage by cleaning the mopping member is 1NTU and the corresponding dirtiness degree is 100, the mopping member dirtiness degree is 100.

In some embodiments, when the first dirtiness degree corresponding to the preset cleaning region is greater than or equal to a preset dirt amount threshold, the preset cleaning region is determined to include the target region; and/or when the first dirtiness degree corresponding to the preset cleaning region is less than the preset dirt amount threshold, the preset cleaning region is determined to not include target region. Illustratively, the dirt amount threshold may be determined according to the maximum dirt value d_max of the mopping member. For example, the dirt amount threshold is positively correlated with the maximum dirt value d_max of the mopping member.

In some embodiments, after mopping of the preset cleaning region has been completed and when the mopping member is being cleaned, the mopping member dirtiness degree of the mopping member is obtained, and the first dirtiness degree of the preset cleaning region is determined according to the mopping member dirtiness degree. When the preset cleaning region includes the target region, the cleaning robot may be controlled to mop at least part of the target region through the mopping member after the mopping member cleaning task is ended.

Illustratively, the dirt amount adhering to the mopping member is the dirt amount picked up from the preset cleaning region, that is, the mopping member dirtiness degree can be configured to represent the dirtiness degree of the preset cleaning region. While performing the mopping member cleaning task, when the mopping member dirtiness degree is greater than or equal to the preset dirt amount threshold, the cleaning robot is then controlled to mop the target region through the mopping member after the mopping member cleaning task is ended. The target region is the region cleaned by the mopping member before the mopping member cleaning task. Typically, the mopping member dirtiness degree is determined according to the dirt elution value in at least the first stage task in the mopping member cleaning task, and when the mopping member dirtiness degree is greater than or equal to the preset dirt amount threshold, the floor mopped by the mopping member is determined to include the target region, and the mopping member cleaning task is ended after the at least first stage task. After the at least first stage task, the mopping member has been cleaned to a certain extent, and it has the capability to adhere dirt, so there is no need to perform subsequent stage tasks, and the mopping member can still have an obvious cleaning effect when repeatedly mopping the target region, thereby reducing the time and the amount of water consumed for cleaning the mopping member.

In some embodiments, there are a plurality of preset cleaning regions. If it is determined in step S130 that the current preset cleaning region includes the target region, the cleaning robot is controlled to mop at least part of the target region through the mopping member after mopping of all the preset cleaning regions and maintenance of the mopping member have been completed. In some embodiments, all the preset cleaning regions are all the preset cleaning regions in the cleaning task map.

For example, as shown in FIG. 10, there are a plurality of preset cleaning regions, including preset cleaning regions from A1 to A9. The cleaning sequence of cleaning the preset cleaning regions from A1 to A9 is, for example, A1, A2, . . . , and A9. After mopping the preset cleaning region A1, the preset cleaning region A1 is determined to include a target region and is marked as including the target region. Then, after maintenance of the mopping member, the preset cleaning regions from A2 to A9 are mopped according to the cleaning sequence. After mopping the preset cleaning region A2, the preset cleaning region A2 is determined to include a target region and is marked as including the target region. After mopping the preset cleaning region A4, the preset cleaning region A4 is determined to include a target region. After mopping the preset cleaning region A7, the preset cleaning region A7 is determined to include a target region. As shown in FIG. 10, the gray regions represent the preset cleaning regions including the target regions.

After mopping of the preset cleaning region A9 has been completed and maintenance of the mopping member, the cleaning robot is controlled to mop at least part of the target regions of the preset cleaning regions A1, A2, A4 and A7 through the mopping member. By mopping the at least part of the target regions after mopping of all the preset cleaning regions has been completed, all the preset cleaning regions in the cleaning task map can first be cleaned at least once. For example, when several preset cleaning regions in the cleaning task map are relatively dirty, the floor corresponding to the cleaning task map can be made less dirty as soon as possible.

In some other embodiments, there are a plurality of preset cleaning regions. If it is determined in step S130 that the current preset cleaning region includes the target region, before mopping the other preset cleaning regions, the mopping member is maintained, and then the cleaning robot is controlled to mop at least part of the target region through the mopping member.

Referring to FIG. 10, after the preset cleaning region A1 is mopped, the preset cleaning region A1 is determined to include a target region, and the mopping member, after being maintained, mops at least part of the target region of the preset cleaning region A1, thereby allowing the preset cleaning region A1 to be clean as soon as possible. Then, the mopping member mops the preset cleaning regions from A2 to A9 according to the cleaning sequence. After the preset cleaning region A2 is mopped, the preset cleaning region A2 is determined to include a target region, and the mopping member, after being maintained, mops at least part of the target region of the preset cleaning region A2. After that, the preset cleaning region A3 is mopped. Illustratively, when there is a preset cleaning region that is relatively dirty in the cleaning task map, for example, a preset cleaning region is covered with dirty liquid, the preset cleaning region is cleaned first, and then the remaining preset cleaning regions are cleaned. In this way, the remaining preset cleaning regions are cleaned after cleaning the dirty preset cleaning region, so that even if the dirt adhering to the mopping member contaminates the remaining preset cleaning regions when the cleaning robot moves towards the base station through these remaining preset cleaning regions after repeatedly mopping the target region, the contamination can be cleaned off during cleaning of these remaining preset cleaning regions.

In some other embodiments, there are a plurality of preset cleaning regions. When the first dirtiness degree of the current preset cleaning region is greater than or equal to a preset first dirt amount threshold, the current preset cleaning region is determined to include a target region. Before mopping the other preset cleaning regions, the mopping member is maintained, and then the cleaning robot is controlled to mop at least part of the target region through the mopping member. That is, when the first dirtiness degree is greater than or equal to the preset first dirt amount threshold, the cleaning robot is immediately controlled to mop at least part of the target region through the mopping member. When the first dirtiness degree of the preset cleaning region is greater than or equal to a preset second dirt amount threshold and less than the preset first dirt amount threshold, the preset cleaning region is determined to include a target region. After mopping of all the preset cleaning regions and maintenance of the mopping member have been completed, the cleaning robot is controlled to mop at least part of the target region through the mopping member. The first dirtiness degree of the preset cleaning region is determined according to the mopping member dirtiness degree. When the first dirtiness degree of the preset cleaning region is greater than or equal to the preset first dirt amount threshold, the cleaning robot is immediately controlled to mop at least part of the target region with the mopping member; when the first dirtiness degree of the preset cleaning region is greater than or equal to the preset second dirt amount threshold and is less than the preset first dirt amount threshold, the cleaning robot is controlled to mop at least part of the target region through the mopping member after all the preset cleaning regions has been mopped once and the mopping member is maintained.

The second dirt amount threshold is less than the first dirt amount threshold. When the first dirtiness degree of the current preset cleaning region is greater than or equal to the first dirt amount threshold, it can be determined that the preset cleaning region is very dirty. First, at least part of the target region of the preset cleaning region is cleaned multiple times, to make the at least part of the target region relatively clean (for example, allowing the dirtiness degree to be less than the first dirt amount threshold) or very clean (for example, allowing the dirtiness degree to be less than the second dirt amount threshold) as soon as possible, and then the remaining preset cleaning regions are cleaned. In this way, even if the dirt adhering on the mopping member contaminates the remaining preset cleaning regions when the cleaning robot moves towards the base station through these remaining preset cleaning regions after repeatedly mopping the target region, the contamination can be cleaned off during cleaning these remaining preset cleaning regions. When the first dirtiness degree of the current preset cleaning region is greater than or equal to the second dirt amount threshold and less than the first dirt amount threshold, it can be determined that the preset cleaning region is not very dirty. First, the remaining preset cleaning regions are cleaned, so that the floor corresponding to the cleaning task map can first be cleaned at least once as soon as possible, thereby making the floor look less dirty overall.

In some embodiments, the determining the cleaning threshold of the mopping member cleaning task according to the task progress of the preset cleaning task includes: determining the cleaning threshold to be a first in-task cleaning threshold when the task progress of the preset cleaning task is that the preset cleaning task has not been finished and the next sub-cleaning task is to mop at least part of the target region, wherein the target region is a preset cleaning region that needs to be repeatedly mopped; and determining the cleaning threshold to be a second in-task cleaning threshold when the task progress of the preset cleaning task is that the preset cleaning task has not been finished and the next sub-cleaning task is that to mop a preset cleaning region in the cleaning task map that has not yet been mopped.

In some embodiments, the cleaning threshold includes a cleaning dirt threshold, and the ending the mopping member cleaning task according to the cleaning threshold includes: ending the mopping member cleaning task when the mopping member dirtiness degree of the mopping member is less than or equal to the cleaning dirt threshold during performing the mopping member cleaning task.

Illustratively, during performing the mopping member cleaning task, when the current mopping member dirtiness degree is lower than the cleaning dirt threshold, it can be determined that the mopping member is cleaned to meet a requirement, and the cleaning of the mopping member can be ended. For example, the mopping member can be configured to mop a preset cleaning region, or the preset cleaning task can be ended.

In some embodiments, the second in-task cleaning dirt threshold is less than the first in-task cleaning dirt threshold. For example, before mopping the preset cleaning region that has not been cleaned, the mopping member is cleaned to be cleaner, so that the cleaned mopping member can adhere more dirt when mopping the preset cleaning region, thereby improving the cleaning effect of the preset cleaning region. Before mopping the target region that has been mopped, the mopping member cleaning task can be ended earlier according to the greater first in-task clean threshold to improve the working efficiency of the cleaning robot in performing the preset cleaning task, since on one hand, the mopping member has a certain capability to adhere dirt after being cleaned to satisfy a greater cleaning dirt threshold, and on the other hand, there is less dirt amount in the target region.

When the first dirtiness degree of the preset cleaning region is relatively large, it indicates that the preset cleaning region that has been mopped is still dirty. When repeated mopping of the floor is needed, if the mopping member is cleaned to be very clean and then controlled to repeatedly mop the floor, this would produce an equivalent cleaning effect to the situation that the mopping member is cleaned to be generally clean and then controlled to repeatedly mop the floor. However, the amount of water and the time consumed for cleaning the mopping member to be very clean is quite different from that consumed for cleaning the mopping member to be generally clean. Therefore, when the floor needs to be repeatedly mopped, cleaning the mopping member to be very clean is less rewarding than cleaning the mopping member to be generally clean, the former of which affects the working efficiency of the cleaning robot and is more wasteful of water.

In some embodiments, the mopping member dirtiness degree is obtained by a sensor, such as a vision sensor or an infrared sensor.

In some embodiments, the mopping member dirtiness degree of the mopping member is determined according to the detection value of the sewage generated by cleaning the mopping member.

In some embodiments, the mopping member cleaning task for cleaning the mopping member includes one or more stage tasks. In each stage task, the cleaning water is supplied to the cleaning sink of the base station to clean the mopping member, and then the sewage generated after cleaning the mopping member is recycled. This process may be done without looping or may loop multiple times. Alternatively, the cleaning water is supplied to the cleaning sink to clean the mopping member, and the sewage after cleaning the mopping member is recycled simultaneously. The present disclosure is certainly not limited thereto. For example, during supplying cleaning water to the cleaning sink, the sewage generated after cleaning the mopping member may be intermittently recycled.

The time and/or the amounts of water consumed for cleaning the mopping member corresponding to different stage tasks may be the same or different. According to the time and/or the amounts of water corresponding to one or more stage tasks in the mopping member cleaning task, the dirt amount corresponding to the detection value obtained during performing each stage task is accumulated to obtain an accumulated dirt amount result d.

In some embodiments, the detection value, such as the turbidity of the sewage, is directly used as the dirt amount. The mopping member dirtiness degree is determined according to the accumulated dirt amount result. For example, the mopping member dirtiness degree d, namely the accumulated dirt amount result, may be obtained by integrating the turbidity T of the sewage over the amount of water l consumed for cleaning the mopping member, which is expressed as follows:

$$d=\int Tdl$$

When the sewage detection sensor has a limit in water volume of detection and a limit in frequency of detection, the accumulated dirt amount result d may be determined according to the detection values obtained in one or more sampling operations and the amounts of water in the sampling intervals, which is expressed as follows:

$$d=\Sigma T_i \times l_i$$

Wherein $T_i$ represents the turbidity T of the sewage at the $i^{th}$ sampling operation, $l_i$ represents the amount of water between two sampling operations, i is any number of 1, 2, . . . , and n, and n is a total number of the sampling operations.

For example, the mopping member dirtiness degree of the mopping member may be pre-judged according to a single detection value. For example, after stopping supplying cleaning water to the cleaning sink, the sewage is recycled. During recycling the sewage, the turbidity of the sewage is detected once, and the amount of the recycled sewage is obtained. The product of the turbidity of the sewage and the amount of the sewage may be determined as the accumulated dirt amount result d. The present disclosure is certainly not limited thereto. For example, during recycling the sewage, the turbidity of the sewage is detected multiple times. The product of an average value, the maximum value, or the minimum value of the multiple detected turbidity values of the sewage and the amount of the sewage is determined as the accumulated dirt amount result d.

In some embodiments, the dirt amounts corresponding to the detection values are accumulated according to the time and/or the amount of water consumed for cleaning the mopping member. The accumulated result of the dirt amounts represents the dirt amount cleaned from the mopping member, which may be called the dirt elution value.

In each stage task, the detection value of the sewage may be obtained only once; alternatively, the detection values of the sewage may be obtained multiple times, and the dirt elution value in this stage task is determined according to one or more of the detection values. For example, the dirt elution value in this stage task is determined according to the product of an average value of a plurality of detection values and the amount of water in this stage task.

Illustratively, in the mopping member cleaning task, the dirt elution value of the mopping member in each stage task is obtained. When the dirt elution value in a stage task is less than or equal to the cleaning threshold, the mopping member cleaning task is ended. A current mopping member dirtiness degree can be determined according to the dirt elution value of the mopping member when being cleaned in the current stage task, the smaller the dirt elution value, the lower the current mopping member dirtiness degree, that is, the cleaner the mopping member. When the dirt elution value of the mopping member in the current stage task is less than or equal to the corresponding cleaning threshold, the mopping member cleaning task is ended, that is, the current stage task is the last stage task in the mopping member cleaning task.

In some embodiments, the mopping member dirtiness degree is determined according to the detection value of the sewage generated by cleaning the mopping member and a zero-bias value of the mopping member. For example, the dirt elution value in each stage task is determined according to the detection value of the sewage in each stage task and the zero-bias value. Illustratively, the zero-bias value is the detection value obtained by the sewage detection sensor detecting clean water or sewage whose cleanliness is close to clean water. The difference between the detection value of the sewage and the zero-bias value provides a more accurate indication of the dirt amount generated by the mopping member cleaning the floor and the elution amount by cleaning the mopping member, thereby eliminating deviations caused by errors of the sewage detection sensor and/or aging of the mopping member. For example, during cleaning the mopping member, when the detection value of the sewage detection sensor reaches a stable value, for example, there is no change for the detection value during a period of time, or the slope of the change is basically 0, then the stable value is determined to be the zero-bias value.

Illustratively, the zero-bias value includes a first zero-bias value that is pre-stored and factory-set, and/or a second zero-bias value that is updated according to the detection value of the sewage detection sensor. For example, when a mopping member has not been used, or the second zero-bias value has not been determined by the mopping member or the second zero-bias value is lost, the mopping member dirtiness degree of the mopping member may be determined according to the first zero-bias value that is factory-set. When the second zero-bias value is stored, then the second zero-bias value is used in preference. For example, when a mopping member that has not been used is cleaned for the first time, the second zero-bias value is determined according to the first zero-bias value and the detection value of the sewage generated by cleaning the mopping member. Then, the mopping member dirtiness degree of the mopping member is determined according to the second zero-bias value and the detection value. In addition, the second zero-bias value may be calibrated according to the detection value.

In some embodiments, the method further includes: obtaining the detection value of the sewage generated by cleaning the mopping member after ending the mopping member cleaning task and/or before mopping the floor through the mopping member; and calibrating the zero-bias value according to the detection value when an absolute value of a difference between the detection value and the zero-bias value is less than or equal to a first difference threshold.

For example, when the preset cleaning task has been finished, the mopping member cleaning task is ended according to the post-task cleaning threshold when performing the mopping member cleaning task. Then, it is determined whether an absolute value of a difference between the detection value of the sewage generated by cleaning the mopping member and the first zero-bias value/the second zero-bias value is less than or equal to the first difference threshold value, when it is determined that the mopping member cleaning task is ended or after the mopping member cleaning task is ended. When the absolute value of the difference is less than or equal to the first difference threshold value, the second zero-bias value is updated to the detection value. This can eliminate deviations caused by errors of the sewage detection sensor and/or the aging of the mopping member, when the detection value of the sewage is determined according to the first zero-bias value/the second zero-bias value.

In some embodiments, the method further includes: continuing to perform the next stage task, when an absolute value of a difference between the detection value in the one or more performed stage tasks in the mopping member cleaning task and the zero-bias value is greater than the first difference threshold; and calibrating the zero-bias value according to the detection value of the next stage task, when an absolute value of a difference between the detection value of the next stage task and the zero-bias value is less than or equal to the second difference threshold, and an absolute value of a difference between the detection value of the next stage task and the detection value of the latest performed stage task is less than or equal to the third difference threshold. For example, when the absolute value of the difference between the detection value and the zero-bias value is greater than the first difference threshold, continue to cleaning the mopping member; and the second zero-bias value is updated to the latest detection value, when the mopping member dirtiness degree is stable (the absolute value of the difference between the detection values of two adjacent stage tasks is less than or equal to the third difference threshold), and the absolute value of the difference between the latest detection value and the zero-bias value is less than or equal to the second difference threshold. In some embodiments, the second difference threshold is greater than or equal to the first difference threshold, so that the second zero-bias value can still be updated according to the detection value when the mopping member is aged.

In some embodiments, the method further includes: when the absolute value of the difference between the detection values of two adjacent stage tasks in the mopping member cleaning task is greater than the third difference threshold, continuing to perform the next stage task until the absolute value of the difference between the detection values of the two adjacent stage tasks is less than or equal to the third difference threshold. When the mopping member dirtiness degree is unstable, it cannot be determined that the mopping member has been cleaned as clean as it can be, then the cleaning of the mopping member is continued, until the mopping member dirtiness degree is stable. In this case, it can be determined that the mopping member has been cleaned as clean as it can be, and the second zero-bias value is updated according to the stable detection value.

In some embodiments, the method further includes: when the absolute value of the difference between the detection value of the latter one in two adjacent stage tasks and the zero-bias value is greater than the second difference threshold, continuing to perform the next stage task, until the absolute value of the difference between the detection value of the latter one in two adjacent stage tasks and the zero-bias value is less than or equal to the second difference threshold. When the absolute value of the difference between the detection value and the zero-bias value is greater than the second difference threshold, it cannot be determined that the mopping element has been cleaned as clean as it can be, then the cleaning of the mopping element is continued, until the absolute value of the difference between the latest detection value and the zero-bias value is less than or equal to the second difference threshold. The second zero-bias value may be updated to the latest detection value.

In some embodiments, the method further includes: outputting prompt information, when a quantity of the stage tasks reaches a stage quantity threshold. The prompt information is configured for indicating malfunction of the sensor configured to detect the sewage. For example, when the quantity of the stage tasks reaches the stage quantity threshold, but the absolute value of the difference between the detection value in each stage task and the first zero-bias value/the second zero-bias value is still greater than the first difference threshold or the second difference threshold, and the absolute value of the difference between the detection values of two adjacent stage tasks is still greater than the third difference threshold, the mopping member cleaning task can be stopped, and malfunction of the sensor configured to detect the sewage can be determined. The prompt information may be further configured to prompt a user to replace the mopping member.

In some embodiments, the method further includes: outputting prompt information, after a sum of the time/the amount of water consumed in the stage tasks reaches a corresponding threshold. The prompt information is configured to indicate malfunction of the sensor configured to detect the sewage.

In some other embodiments, the cleaning threshold includes a cleaning duration threshold. Illustratively, the ending the mopping member cleaning task according to the cleaning threshold includes: ending the mopping member cleaning task when the cleaning duration for the mopping member reaches the cleaning duration threshold corresponding to the task progress during performing the mopping member cleaning task. That is, the cleaning duration of the mopping member cleaning task can be adjusted according to the task progress of a preset cleaning task, allowing the cleaning duration for the mopping member to correspond to the current task progress, thereby improving the working efficiency of the cleaning robot.

Illustratively, the determining the cleaning threshold of the mopping member cleaning task according to the task progress of the preset cleaning task includes: determining the cleaning duration threshold to be an in-task cleaning duration threshold, when the task progress of the preset cleaning task is that the preset cleaning task has not been finished; and determining the cleaning duration threshold to be a post-task cleaning duration threshold, when the task progress of the preset cleaning task is that the preset cleaning task has been finished. The post-task cleaning duration threshold is greater than the in-task cleaning duration threshold.

When the mopping member will not be used to mop the floor for a long period of time, such as one day, or the current cleaning task has been finished (for example, each preset cleaning region in the cleaning task map does not include a relatively dirty target region), and the next cleaning task will be performed after a preset length of time, it can be determined that the cleaning duration threshold of the current mopping member cleaning task is the post-task cleaning duration threshold with a larger value. In this way, when ending the mopping member cleaning task, the mopping member has been thoroughly cleaned for a long period of time, thereby preventing odors generating within the preset length of time.

Illustratively, when the task progress of the preset cleaning task is that the preset cleaning task has not been finished, and the next sub-cleaning task is to mop at least part of the target region, the cleaning threshold is determined to be a first in-task cleaning duration threshold; and when the task progress of the preset cleaning task is that the preset cleaning task has not been finished, and the next sub-cleaning task is to mop a preset cleaning region in the cleaning task map that has not yet been mopped, the cleaning threshold is determined to be a second in-task cleaning duration threshold. The second in-task cleaning duration threshold is greater than the first in-task cleaning duration threshold. For example, before mopping the preset cleaning region that has not yet been mopped, the mopping member is cleaned for a longer duration, so that when mopping the preset cleaning region, the cleaned mopping member can adhere more dirt, thereby improving the cleaning effect of the preset cleaning region. Before mopping the target region that has been mopped, the mopping member cleaning task can be ended earlier according to a smaller cleaning duration threshold to improve the working efficiency of the cleaning robot in performing the preset cleaning task and save water, since on one hand, the mopping member has a certain capability to adhere dirt after being cleaned for less clean duration, and on the other hand, there is less dirt amount in the target region.

In some other embodiments, the cleaning threshold includes a cleaning water amount threshold, and the ending the mopping member cleaning task according to the cleaning threshold includes: ending the mopping member cleaning task when the amount of water consumed for cleaning the mopping member reaches the cleaning water amount threshold corresponding to the task progress during the mopping member cleaning task. That is, the amount of cleaning water for the mopping member cleaning task is adjusted according to the task progress of the preset cleaning task, allowing the amount of cleaning water for cleaning the mopping member to correspond to the current task progress, thereby improving the working efficiency of the cleaning robot.

Illustratively, the determining the cleaning threshold of the mopping member cleaning task according to the task progress of the preset cleaning task includes: determining the cleaning water amount threshold to be an in-task cleaning water amount threshold when the task progress of the preset cleaning task is that the preset cleaning task has not been finished; and determining the cleaning water amount threshold to be a post-task cleaning water amount threshold when the task progress of the preset cleaning task is that the preset cleaning task has been finished. The post-task cleaning water amount threshold is greater than the in-task cleaning water amount threshold.

When the mopping member will not be used to mop the floor for a long period of time, such as one day, or the current preset cleaning task has been finished (for example, each preset cleaning region in the cleaning task map does not include a relatively dirty region such as the target region), and the next cleaning task will be performed after a preset length of time, the cleaning water amount threshold of the current mopping member cleaning task is determined to be the larger post-task cleaning water amount threshold. In this way, the mopping member has been thoroughly cleaned for a long duration when ending the mopping member cleaning task, thereby preventing odors generating within the preset length of time.

Illustratively, when the task progress of the preset cleaning task is that the preset cleaning task has not been finished, and the next sub-cleaning task is to mop at least part of the target region, the cleaning threshold is determined to be a first in-task cleaning water amount threshold; and when the task progress of the preset cleaning task is that the preset cleaning task has not been finished, and the next sub-cleaning task is to mop a preset cleaning region in the cleaning task map that has not yet been mopped, the cleaning threshold is determined to be a second in-task cleaning water amount threshold. The second in-task cleaning water amount threshold is greater than the first in-task cleaning water amount threshold. For example, the mopping member has been cleaned for a longer duration before mopping the preset cleaning region that has not yet been mopped, so that the cleaned mopping member can adhere more dirt when mopping the preset cleaning region, thereby improving the cleaning effect of the preset cleaning region. Before mopping the target region that has been mopped, the mopping member cleaning task can be ended according to a smaller cleaning water amount threshold to improve the working efficiency of the cleaning robot in performing the preset cleaning task and save water, since on one hand, the mopping member has a certain capability to adhere dirt after being cleaned by less amount of water, and on the other hand, there is less dirt amount in the target region.

The cleaning method for the mopping member provided by embodiments of the present disclosure includes: performing a mopping member cleaning task; obtaining a task progress of a preset cleaning task, wherein the preset cleaning task includes mopping a preset cleaning region in a cleaning task map through the mopping member; determining a cleaning threshold of the mopping member cleaning task according to the task progress of the preset cleaning task; and ending the mopping member cleaning task according to the cleaning threshold. By determining the cleaning threshold of the mopping member cleaning task according to the task progress of the preset cleaning task, the cleanliness level of the mopping member cleaned according to the cleaning threshold is allowed to correspond to the current task progress, thereby improving the working efficiency of the cleaning robot.

Figure 13:
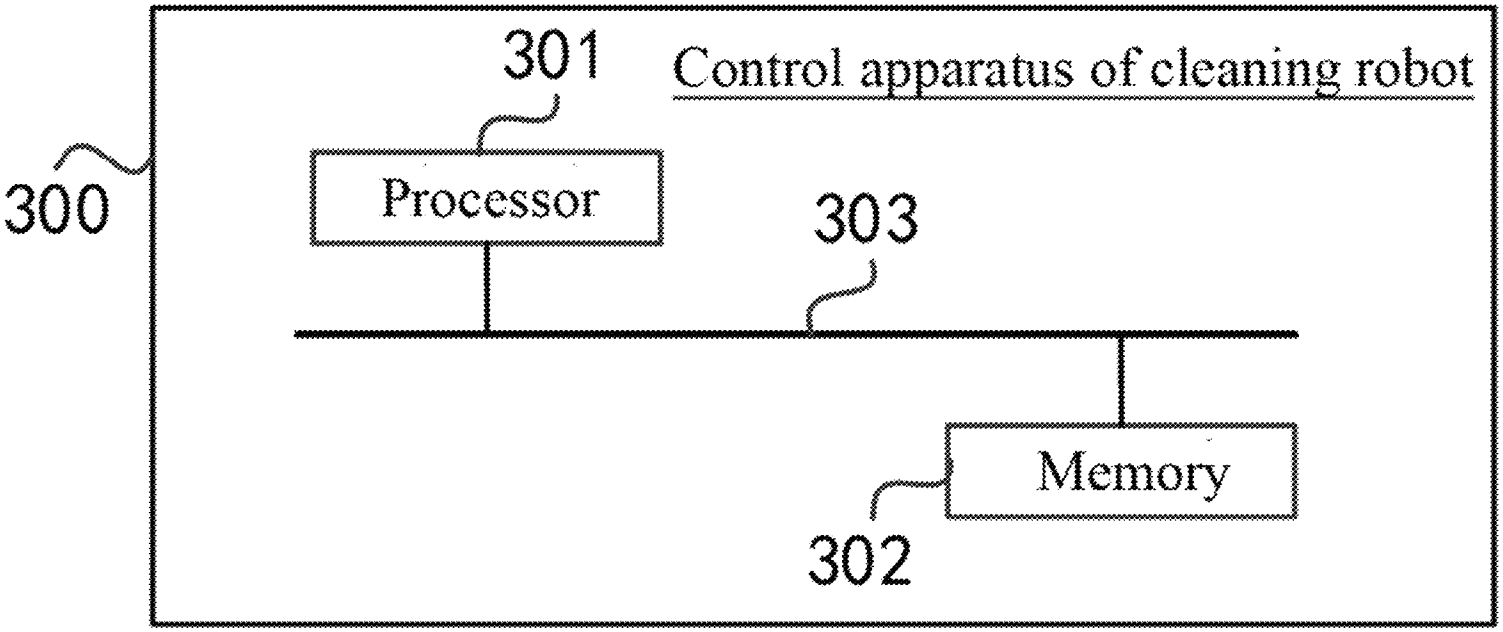
FIG. 13 is a schematic block diagram of a controlling apparatus of a cleaning robot according to an embodiment of the present disclosure.

In combination with the foregoing embodiments and referring to FIG. 13, FIG. 13 is a schematic block diagram of a control apparatus 300 according to an embodiment of the present disclosure. The control apparatus 300 includes a processor 301 and a memory 302.

Illustratively, the processor 301 and the memory 302 are connected through a bus 303, such as an inter-integrated circuit (I2C) bus.

Typically, the processor 301 may be a micro-control unit (MCU), a CPU, or a digital signal processor (DSP).

Typically, the memory 302 may be a flash chip, a read-only memory (ROM) disk, an optical disk, a USB flash drive, or a mobile hard drive.

The processor 301 is configured to run a computer program stored in the memory 302, and implement the steps of the controlling method for the cleaning robot and/or the steps of the cleaning method for the mopping member when executing the computer program.

Illustratively, the processor 301 is configured to run the computer program stored in the memory 302, and implement the following steps when executing the computer program:

controlling the cleaning robot to mop a preset cleaning region through a mopping member;

obtaining a first dirtiness degree corresponding to the preset cleaning region;

determining that the preset cleaning region includes a target region according to the first dirtiness degree, the target region being a region that needs to be repeatedly mopped; and controlling the cleaning robot to mop at least part of the target region through the mopping member after mopping of the preset cleaning region and maintenance of the mopping member have been completed.

Illustratively, the processor 301 is configured to run the computer program stored in the memory 302, and implement the following steps when executing the computer program:

performing a mopping member cleaning task;

obtaining a mopping member dirtiness degree of the mopping member; and determining a cleaning threshold according to a value range where the mopping member dirtiness degree is located, and ending the mopping member cleaning task according to the cleaning threshold.

The specific principle and implementation of the control apparatus provided by the embodiments of the present disclosure are similar to the foregoing method, and will not be detailed herein.

Referring to FIG. 2 to FIG. 6, in some embodiments, the robot controller 104 of the cleaning robot 100 and/or the base station controller 206 of the base station 200 may be used individually or in combination as the control apparatus 300, to implement the steps of the control method for the cleaning robot of the embodiments of the present disclosure and/or to implement the steps of the cleaning method for the mopping member. In some other embodiments, the cleaning system includes a separate control apparatus 300, which is configured to implement the steps of the method of the embodiments of the present disclosure. The control apparatus 300 may be arranged on the cleaning robot 100, or arranged on the base station 200. The present disclosure is certainly not limited thereto. For example, the control apparatus 300 may be an apparatus other than the cleaning robot 100 and the base station 200, such as a home smart terminal, a master control apparatus, and the like.

In some embodiments, the control apparatus 300 on the base station 200, such as the base station controller 206, is configured to implement the steps of the cleaning method for the mopping member of the embodiments of the present disclosure. The control apparatus 300 on the cleaning robot 100, such as the robot controller 104, is configured to implement the steps of the controlling method for the cleaning robot of the embodiments of the present disclosure. The present disclosure is certainly not limited thereto. For example, the control apparatus 300 on the base station 200 may be configured to implement the steps of the controlling method for the cleaning robot of the embodiments of the present disclosure.

An embodiment of the present disclosure further provides a computer-readable storage medium storing a computer program. The computer program, when being executed by a processor, causes the processor to implement the steps of the controlling method for the cleaning robot and/or the steps of the cleaning method for the mopping member.

The computer-readable storage medium may be an internal storage unit of the control apparatus according to any one of the foregoing embodiments, such as a hard disk or memory of the control apparatus. Alternatively, the computer-readable storage medium may be an external storage device of the control apparatus, such as a plug-in hard disk, a smart media card (SMC), a secure digital (SD) card, and a flash card which are arranged on the control apparatus.

An embodiment of the present disclosure further provides a base station, which is at least configured to clean the mopping member of the cleaning robot. The base station further includes the control apparatus 300, such as the base station controller 206, for implementing the steps of the cleaning method for the mopping member of the embodiments of the present disclosure and/or implementing the steps of the controlling method for the cleaning robot according to the embodiments of the present disclosure.

An embodiment of the present disclosure further provides a cleaning robot, including:

- a mopping member;
- a cleaning mechanism configured to clean the mopping member; and
- the foregoing control apparatus 300, such as the robot controller 104, for implementing the steps of the cleaning method for the mopping member according to the embodiments of the present disclosure and/or the steps of the controlling method for the cleaning robot according to the embodiments of the present disclosure.

In combination with the foregoing embodiments and referring to FIG. 2, FIG. 2 is a schematic diagram of a cleaning system according to an embodiment of the present disclosure.

As shown in FIG. 2 to FIG. 6, the cleaning system includes:

- the cleaning robot 100, wherein the cleaning robot 100 includes the walking unit 106 and the mopping member 110, and the walking unit 106 is configured to drive the cleaning robot 100 to move, so as to allow the mopping member 110 to mop the floor;
- the base station 200, wherein the base station 200 is at least configured to clean or replace the mopping member 110 of the cleaning robot 100; and/or the base station 200 including a dirt detection apparatus (not shown in the figures) for detecting the mopping member dirtiness degree of the cleaning robot 100; and
- the control apparatus 300.

Figure 14:
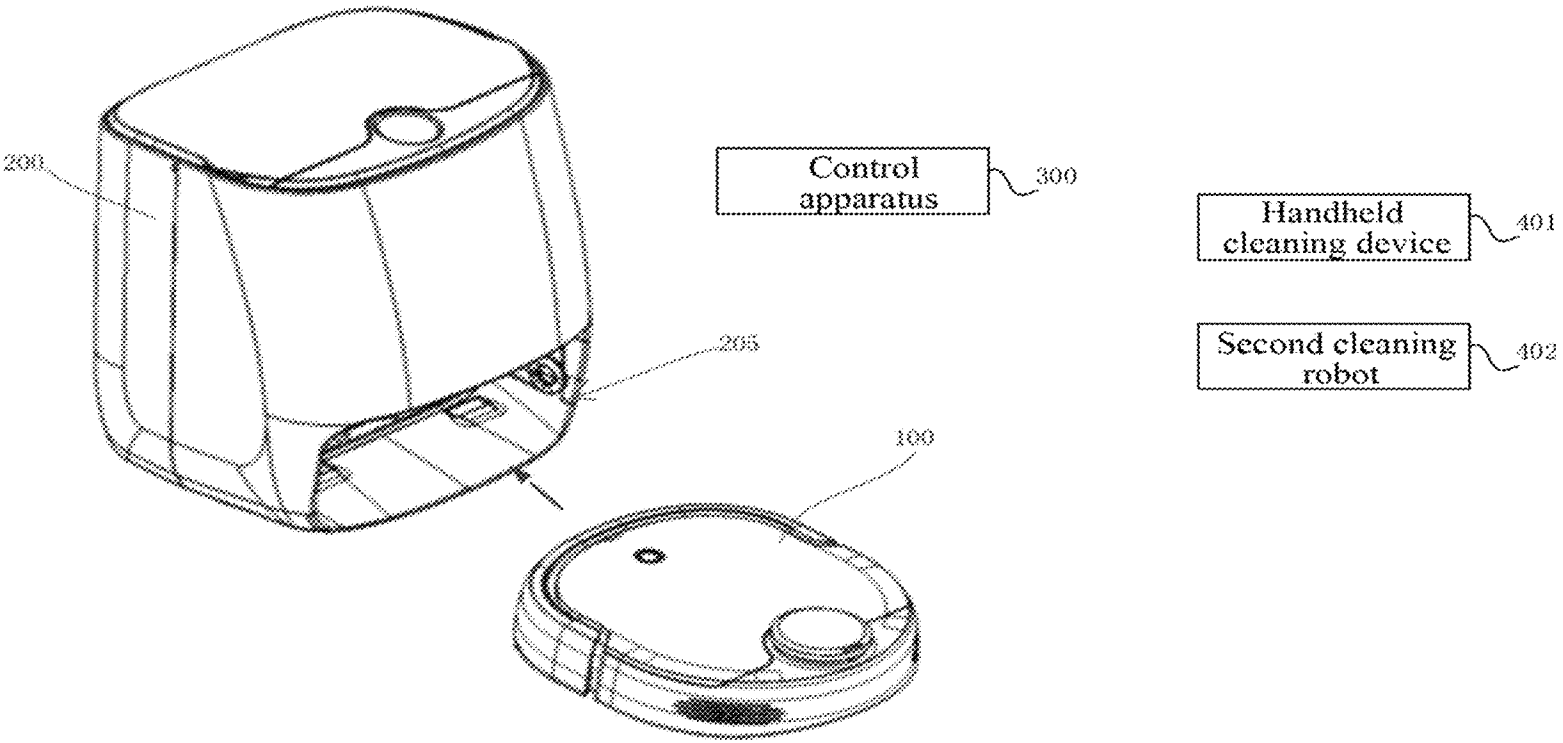
FIG. 14 is a schematic diagram of a cleaning system according to an embodiment of the present disclosure.

In combination with the foregoing embodiments and referring to FIG. 14, FIG. 14 is a schematic diagram of a cleaning system according to an embodiment of the present disclosure. As shown in FIG. 14, the cleaning system includes:

- the first cleaning robot 100, wherein the first cleaning robot 100 includes the walking unit 106 and the mopping member 110, and the walking unit 106 is configured to drive the first cleaning robot 100 to move, so as to allow the mopping member 110 to mop the floor;
- the base station 200, wherein the base station 200 is at least configured to clean the mopping member 110 of the first cleaning robot 100; and
- the control apparatus 300.

The cleaning system further includes:

- the handheld cleaning device 401 or the second cleaning robot 402.

The control apparatus 300 or the first cleaning robot 100 is capable of sending information of the target region to the handheld cleaning device 401 or the second cleaning robot 402. The target region is the region that needs to be repeatedly mopped. In some embodiments, the base station 200 may be further configured to clean the mopping member of the second cleaning robot 402.

The specific principle and implementation of the cleaning system provided by the embodiments of the present disclosure are similar to the controlling method for the cleaning robot in the foregoing embodiments, and will not be detailed herein.

It should be understood that the terms used in the present disclosure are merely for describing the specific embodiments and are not intended to limit the present disclosure.

It should be understood that the term "and/or" as used in the present disclosure and the appended claims refers to any combination and all possible combinations of one or more of the items listed in association, and includes such combinations.

The above description merely describes the specific embodiments, but the protection scope of the present disclosure is not limited thereto. It would be obvious for those skilled in the art to obtain various equivalent modifications or replacements within the technical scope disclosed in the present disclosure, and these modifications or replacements are within the protection scope of the present disclosure. Therefore, the scope of protection of the present disclosure should be based on the scope of the claims.

What is claimed is:

1. A controlling method for a cleaning robot, comprising:

controlling, by a processor, the cleaning robot in a current cleaning task to mop a preset cleaning region in a cleaning task map corresponding to the current cleaning task through a mopping member, comprising:

controlling, by the processor, the cleaning robot to move forward at a constant speed without repeating mopping of the preset cleaning region; and controlling, by the processor, the cleaning robot to stop mopping and return to a base station;

obtaining, by the processor, a first dirtiness degree corresponding to the preset cleaning region, comprising, at each return where the mopping member is cleaned at the base station, detecting, by a dirt detection apparatus comprising at least one sensor, a mopping member dirtiness degree based on color information or sewage of the mopping member at the base station, the first dirtiness degree corresponding to the mopping member dirtiness degree;

determining, by the processor, whether the preset cleaning region comprises a target region according to the first dirtiness degree, the target region being a region that needs to be repeatedly mopped after the preset cleaning region has been mopped; and in response to determining that the preset cleaning region comprises the target region:

determining, by the processor, whether to divide the target region into sub-target regions or, when the target region comprises a plurality of regions, determining, by the processor, whether to merge the plurality of regions, thereby obtaining at least part of the target region;

according to a comparison between the first dirtiness degree and at least one cleaning threshold, determining, by the processor, a repeated mopping order of the at least part of the target region; and controlling, by the processor, the cleaning robot to mop the at least part of the target region, according to the repeated mopping order, through the mopping member after mopping of the preset cleaning region has been completed and after maintenance of the mopping member.

2. The controlling method according to claim 1, wherein the obtaining the first dirtiness degree corresponding to the preset cleaning region comprises:

obtaining the mopping member dirtiness degree of the mopping member after the cleaning robot has completed mopping of the preset cleaning region through the mopping member; and determining the first dirtiness degree corresponding to the preset cleaning region according to the mopping member dirtiness degree.

3. The controlling method according to claim 2, wherein the obtaining the mopping member dirtiness degree of the mopping member comprises:

cleaning the mopping member, and obtaining a detection value of sewage generated by cleaning the mopping member; and determining the mopping member dirtiness degree of the mopping member according to the detection value.

4. The controlling method according to claim 3, wherein the determining the mopping member dirtiness degree of the mopping member according to the detection value comprises:

accumulating dirt amounts corresponding to detection values according to a time and/or an amount of water consumed for cleaning the mopping member, and determining the mopping member dirtiness degree of the mopping member according to an accumulated result of the dirt amounts; or pre-determining the mopping member dirtiness degree of the mopping member according to a single detection value.

5. The controlling method according to claim 1, wherein the cleaning task of the cleaning robot comprises mopping a plurality of preset cleaning regions; and the controlling the cleaning robot to mop the at least part of the target region through the mopping member after mopping of the preset cleaning region has been completed and after maintenance of the mopping member comprises:

controlling the cleaning robot to mop the at least part of one or more target regions through the mopping member after mopping of all of the plurality of preset cleaning regions has been completed and after maintenance of the mopping member, or controlling the cleaning robot to mop the at least part of the target region through the mopping member before mopping the other preset cleaning regions other than the preset cleaning region corresponding to the target region and after maintenance of the mopping member.

6. The controlling method according to claim 5, further comprising:

determining a mopping order of a plurality of target regions according to characteristic parameters of the plurality of target regions after mopping of all of the plurality of preset cleaning regions has been completed, the characteristic parameter of each target region at least comprising: a dirtiness degree corresponding to the target region, a distance between the target region and the cleaning robot, and a room identifier of a room where the target region is located; and the controlling the cleaning robot to mop the at least part of the target region through the mopping member comprises:

controlling the cleaning robot to mop at least part of the plurality of target regions according to the mopping order.

7. The controlling method according to claim 6, wherein the controlling the cleaning robot to mop at least part of the plurality of target regions according to the mopping order comprises:

controlling the cleaning robot to mop the at least part of the plurality of target regions according to an order of the dirtiness degrees from largest to smallest; or, controlling the cleaning robot to mop the at least part of the plurality of target regions according to an order of the dirtiness degrees from smallest to largest; or, controlling the cleaning robot to mop the at least part of the plurality of target regions according to an order of a distance between each target region and the cleaning robot from nearest to farthest; or, controlling the cleaning robot to mop the at least part of the plurality of target regions according to an order of a distance between each target region and the cleaning robot from farthest to nearest.

8. The controlling method according to claim 6, wherein the determining the mopping order of the plurality of target regions according to the dirtiness degrees of the plurality of target regions after mopping of all of the plurality of preset cleaning regions has been completed comprises:

determining target regions that have dirtiness degree differences therebetween less than or equal to a difference threshold as a merged region;

determining a dirtiness degree of the merged region according to the dirtiness degrees of target regions in a same merged region; and determining a mopping order of a plurality of merged regions according to the dirtiness degrees of the plurality of merged regions; or, when there are one or more target regions not being merged, determining a mopping order of one or more merged regions and the one or more unmerged target regions according to the dirtiness degrees of the one or more merged regions and the one or more unmerged target regions.

9. The controlling method according to claim 8, wherein the controlling the cleaning robot to mop the target region through the mopping member comprises:

controlling the cleaning robot to mop the target regions in the merged region through the mopping member when the dirtiness degree of the merged region is less than or equal to a preset merge dirt threshold.

10. The controlling method according to claim 1, wherein the determining that the preset cleaning region comprises the target region according to the first dirtiness degree, the target region being the region that needs to be repeatedly mopped, comprises:

determining that the preset cleaning region comprises the target region when the first dirtiness degree corresponding to the preset cleaning region is greater than or equal to a preset dirt amount threshold.

11. The controlling method according to claim 10, wherein the cleaning task of the cleaning robot comprises mopping a plurality of preset cleaning regions; and the dirt amount threshold comprises a first dirt amount threshold and a second dirt amount threshold;

determining that the preset cleaning region comprises the target region when the first dirtiness degree is greater than or equal to the first dirt amount threshold; and controlling the cleaning robot to mop the at least part of the target region through the mopping member before mopping the other preset cleaning regions other than the current preset cleaning region and after maintenance of the mopping member; or determining that the preset cleaning region comprises the target region when the first dirtiness degree is greater than or equal to the second dirt amount threshold and less than the first dirt amount threshold; and controlling the cleaning robot to mop the at least part of one or more target regions through the mopping member after mopping of all of the plurality of preset cleaning regions has been completed and after maintenance of the mopping member.

12. The controlling method according to claim 11, wherein the determining that the preset cleaning region comprises the target region when the first dirtiness degree is greater than or equal to the first dirt amount threshold; and controlling the cleaning robot to mop the at least part of the target region through the mopping member before mopping the other preset cleaning regions other than the current preset cleaning region and after maintenance of the mopping member, comprises:

controlling the cleaning robot to mop the at least part of the target region through the mopping member immediately when the first dirtiness degree is greater than or equal to the first dirt amount threshold and obtaining a second dirtiness degree corresponding to the target region; when the second dirtiness degree is greater than the second dirt amount threshold, controlling the cleaning robot to continue mopping the target region again until the second dirtiness degree is less than the second dirt amount threshold; and mopping the other preset cleaning regions after mopping of the at least part of the target region has been completed and after maintenance of the mopping member; or controlling the cleaning robot to mop the target region through the mopping member immediately when the first dirtiness degree is greater than or equal to the first dirt amount threshold and obtaining a second dirtiness degree corresponding to the target region; when the second dirtiness degree is greater than the first dirt amount threshold, controlling the cleaning robot to continue mopping the target region again until the second dirtiness degree is greater than or equal to the second dirt amount threshold and less than the first dirt amount threshold; and controlling the cleaning robot to mop the at least part of the target region through the mopping member after mopping of all of the plurality of preset cleaning regions has been completed and after maintenance of the mopping member.

13. The controlling method according to claim 10, wherein the dirt amount threshold is determined according to a cleaning mode of the cleaning robot.

14. The controlling method according to claim 1, wherein the controlling the cleaning robot to mop the at least part of the target region through the mopping member further comprises:

obtaining a second dirtiness degree corresponding to the target region;

determining whether the target region is to be mopped again repeatedly according to the second dirtiness degree corresponding to the target region; and mopping the at least part of the target region again repeatedly.

15. The controlling method according to claim 14, wherein after the mopping the at least part of the target region again repeatedly, the controlling method further comprises:

ending again repeated mopping of the target region when a number of times the target region is again repeatedly mopped meets a cleaning times threshold.

16. The controlling method according to claim 1, wherein the controlling the cleaning robot to mop the at least part of the target region through the mopping member comprises:

dividing the target region into sub-target regions, and controlling the cleaning robot to mop at least one of the sub-target regions through the mopping member.

17. The controlling method according to claim 16, wherein the controlling the cleaning robot to mop the at least one of the sub-target regions through the mopping member comprises:

controlling the cleaning robot to mop the sub-target regions in sequence through the mopping member; obtaining a third dirtiness degree of the sub-target region, and determining that the sub-target region needs to be mopped repeatedly; and continuing to divide the sub-target region, and mopping the divided regions; or controlling the cleaning robot to mop one of the sub-target regions through the mopping member; estimating a second dirtiness degree of the target region, obtaining a third dirtiness degree of the sub-target region, determining that the repeated mopping of the target region has not been completed according to the second dirtiness degree and the third dirtiness degree; and repeatedly mopping a next sub-target region.

18. A control apparatus, comprising a memory and a processor, wherein, the memory is configured to store a computer program;

the processor is configured to execute the computer program, and, when executing the computer program, implement:

the operations of the controlling method for the cleaning robot according to claim 1.

19. The controlling method according to claim 1, further comprising:

obtaining, by the processor, a prediction model through fitting number of stage tasks and dirt elution value of each stage task in a mopping member cleaning task; and predicting, by the processor, the mopping member dirtiness degree according to dirt elution values of a plurality of performed stage tasks based on the prediction model.

20. The controlling method according to claim 1, further comprising:

in response to determining that the preset cleaning region comprises the target region, transmit, by the processor, a message to a user interface of the cleaning robot.

* * * * *